US011834966B1

(12) United States Patent
Humes et al.

(10) Patent No.: US 11,834,966 B1
(45) Date of Patent: Dec. 5, 2023

(54) SYSTEMS AND METHODS FOR MULTI-DIMENSIONAL VARIABLE VANE STAGE RIGGING UTILIZING ADJUSTABLE ALIGNMENT MECHANISMS

(71) Applicant: Rolls-Royce North American Technologies Inc., Indianapolis, IN (US)

(72) Inventors: Ryan Humes, Indianapolis, IN (US); Andrew Eifert, Indianapolis, IN (US); Paulo Bazan, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 18/091,905

(22) Filed: Dec. 30, 2022

(51) Int. Cl.
*F01D 5/02* (2006.01)
*F01D 9/04* (2006.01)

(52) U.S. Cl.
CPC ..... *F01D 9/041* (2013.01); *F05D 2220/32* (2013.01); *F05D 2240/12* (2013.01)

(58) Field of Classification Search
CPC .. F01D 17/162; F01D 25/243; F05D 2260/50; F05D 2240/12; F05D 2220/32; F02C 9/20
USPC ..... 415/129
See application file for complete search history.

(56) References Cited

U.S. PATENT DOCUMENTS 3,914,066 A 10/1975 Downing
5,492,446 A 2/1996 Hawkins et al.
5,692,879 A 12/1997 Charbonnel
5,807,072 A 9/1998 Payling
5,993,152 A 11/1999 Schilling
6,769,868 B2 8/2004 Harrold
7,413,401 B2 8/2008 Szucs et al.
8,297,918 B2 10/2012 Bhatnagar
8,333,546 B2 12/2012 Colotte et al.
8,393,857 B2 3/2013 Copeland et al.
8,727,697 B2 5/2014 Eifert
9,353,643 B2 5/2016 Major
9,645,050 B2 5/2017 Allford
9,822,651 B2 * 11/2017 LeBlanc ..... F02C 9/20
10,100,663 B2 10/2018 Longworth et al.
10,196,925 B2 2/2019 Siebert
10,288,079 B2 5/2019 Skertic
10,301,962 B2 5/2019 Chandler et al.
10,352,187 B2 7/2019 Keenan
10,364,828 B2 7/2019 Ikeguchi et al.
10,393,145 B2 8/2019 Medina Cruz et al.
10,443,431 B2 10/2019 Suciu et al.
(Continued)

*Primary Examiner* — Long T Tran
*Assistant Examiner* — James J Kim
(74) *Attorney, Agent, or Firm* — Barnes & Thornburg LLP

(57) ABSTRACT

A vane adjustment assembly includes a plurality of vanes, an annular ring coupled to the vanes, and a ring adjustment assembly. The ring adjustment assembly includes a shim plate having a first shim surface removably arranged on an axially facing surface of the annular ring, a carrier plate having a first carrier surface removably arranged on a second shim surface of the shim plate opposite the first shim surface, and a roller pin coupled to a second carrier surface of the carrier plate opposite the first carrier surface. The shim plate is sized so as to locate the roller pin at a predetermined distance from the annular ring so as to adjust a position of the plurality of variable vanes relative to the roller pin.

20 Claims, 18 Drawing Sheets

(56) References Cited

U.S. PATENT DOCUMENTS

| | | | | |
|---|---|---|---|---|
| 10,458,271 | B2 | 10/2019 | Chandler et al. | |
| 10,508,660 | B2 | 12/2019 | Hall et al. | |
| 10,626,747 | B2 | 4/2020 | Karapurath | |
| 10,634,000 | B2 | 4/2020 | Skertic et al. | |
| 10,662,804 | B2 | 5/2020 | Awtry et al. | |
| 10,753,231 | B2 | 8/2020 | Mena-Dominguez et al. | |
| 10,815,802 | B2 | 10/2020 | Prasad | |
| 10,927,699 | B2 | 2/2021 | Bromann et al. | |
| 11,105,219 | B2 | 8/2021 | Ward | |
| 11,125,115 | B2 | 9/2021 | Humhauser | |
| 11,131,323 | B2 | 9/2021 | Suciu et al. | |
| 11,371,380 | B2 | 6/2022 | Poick | |
| 11,560,810 | B1 * | 1/2023 | Argote | F01D 17/162 |
| 2012/0195755 | A1 * | 8/2012 | Gasmen | F01D 25/246<br>415/230 |
| 2014/0234082 | A1 * | 8/2014 | LeBlanc | F04D 29/563<br>29/888.025 |
| 2019/0093502 | A1 | 3/2019 | Lyon et al. | |
| 2020/0088108 | A1 | 3/2020 | Klein et al. | |
| 2020/0116042 | A1 * | 4/2020 | Koletzki | F01D 17/162 |

* cited by examiner

SYSTEMS AND METHODS FOR MULTI-DIMENSIONAL VARIABLE VANE STAGE RIGGING UTILIZING ADJUSTABLE ALIGNMENT MECHANISMS

FIELD OF THE DISCLOSURE

The present disclosure relates generally to gas turbine engines, and more specifically to variable vane assemblies of gas turbine engines.

BACKGROUND

Gas turbine engines are used to power aircraft, watercraft, power generators, and the like. Gas turbine engines typically include an engine core having a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Leftover products of the combustion are exhausted out of the turbine and may provide thrust in some applications.

Gas turbine engines also typically include vane assemblies arranged within the engine components, such as inlet guide vanes and stator vanes. To provide for the necessary stall or surge margin at different power settings throughout operation of the gas turbine engine, variable, or adjustable, vanes may be utilized, such as variable inlet guide vanes and/or variable stator vanes. It is important to position of the vanes with extreme precision in order to accurately direct airflow within the engine.

SUMMARY

The present disclosure may comprise one or more of the following features and combinations thereof.

According to a first aspect of the present disclosure, a vane adjustment assembly for a gas turbine engine includes a plurality of variable vanes extending radially outward relative to a central axis of the gas turbine engine, an annular ring arranged radially outward of the central axis and coupled to the plurality of variable vanes, and a ring adjustment assembly. The ring adjustment assembly includes a shim plate having a first shim surface removably arranged on an axially facing surface of the annular ring, a carrier plate having a first carrier surface removably arranged on a second shim surface of the shim plate opposite the first shim surface, and a roller pin coupled to a second carrier surface of the carrier plate opposite the first carrier surface. In some embodiments, the shim plate is sized so as to locate the roller pin at a predetermined distance from the annular ring so as to adjust a position of the plurality of variable vanes relative to the roller pin.

In some embodiments, the ring adjustment assembly further includes a first fastener extending axially through the annular ring, through the shim plate, and through the carrier plate. In some embodiments, the carrier plate further includes a first recess formed in the second carrier surface. The recess opens axially outwardly away from the annular ring. The carrier plate includes a first opening formed in a bottom surface of the first recess extends axially through the carrier plate, and the first fastener extends through the first opening and extends beyond the second carrier surface of the carrier plate.

In some embodiments, the ring adjustment assembly further includes a first adjustment plate arranged within the first recess. The first adjustment plate includes a first adjustment opening that extends axially through the first adjustment plate, and the first fastener extends through the first adjustment opening.

In some embodiments, the first fastener is removable such that the first fastener, the shim plate, the carrier plate, and the first adjustment plate are configured to be removed and reattached to the annular ring via replacing the first fastener, and the first adjustment plate is configured to be arranged within the first recess at a plurality of rotational positions therein relative to a central axis of the first adjustment plate that extends in an axial direction relative to the annular ring.

In some embodiments, the first adjustment opening is offset from the central axis of the first adjustment plate in at least one of a circumferential direction of the annular ring and a radial direction of the annular ring. In some embodiments, the first adjustment opening is offset from the central axis of the first adjustment plate in a first circumferential direction of the annular ring such that the carrier plate and the roller pin are offset from the shim plate in a second circumferential direction opposite the first circumferential direction. In some embodiments, the first adjustment opening is offset from the central axis of the first adjustment plate in a first radial direction of the annular ring such that the carrier plate and the roller pin are offset from the shim plate in a second radial direction opposite the first radial direction.

In some embodiments, the roller pin is selectively movably coupled to a casing of the gas turbine engine such that movement of the roller pin relative to the casing further adjusts the position of the annular ring relative to the casing, the roller pin is selectively movably coupled to the casing via a cam plate that is slidably coupled to the casing and slidable relative thereto, and the cam plate includes at least one slot within which the roller pin is slidably arranged. In some embodiments, sliding of the cam plate relative to the casing in an axial direction causes the roller pin to slidably move within the at least one slot and further adjust a position of the annular ring relative to the casing, and the roller pin includes a roller pin head configured to be slidably arranged within the at least one slot and engage with edges of the at least one slot.

According to a further aspect of the present disclosure, a method of adjusting a position of a plurality of variable vanes of a gas turbine engine includes arranging the plurality of variable vanes around a central axis of the gas turbine engine, arranging an annular ring radially outward of the central axis, and coupling the annular ring to the plurality of variable vanes. The method can further include arranging a carrier plate adjacent to the annular ring, the carrier plate having a roller pin coupled to a second carrier surface of the carrier plate opposite a first carrier surface, and arranging a first shim plate between the carrier plate and the annular ring, the first shim plate sized so as to locate the roller pin at a first predetermined distance from the annular ring so as to adjust a position of the plurality of variable vanes relative to the roller pin.

In some embodiments, the method further includes inserting a first fastener axially into the annular ring such that the first fastener extends axially through the annular ring, through the shim plate, and through the carrier plate so as to couple the shim plate and the carrier plate to the annular ring. In some embodiments, the method further includes removing the first shim plate from between the carrier plate and the annular ring and inserting a second shim plate between the carrier plate and the annular ring, the second shim plate having a thickness as measured in an axial direction relative to the annular ring different than the first shim plate so as to locate the roller pin at a second predetermined distance from the annular ring different than the first predetermined distance so as to adjust a position of the plurality of variable vanes relative to the roller pin.

In some embodiments, the carrier plate further includes a first recess formed in the second carrier surface. The recess opens axially outwardly away from the annular ring, the carrier plate includes a first opening formed in a bottom surface of the first recess that extends axially through the carrier plate, and the first fastener extends through the first opening and extends beyond the second carrier surface of the carrier plate.

In some embodiments, the method further includes arranging a first adjustment plate within the first recess. The first adjustment plate includes a first adjustment opening that extends axially through the first adjustment plate, and the first fastener extends through the first adjustment opening. In some embodiments, the first adjustment opening is offset from a central axis of the adjustment plate extending in an axial direction relative to the annular ring in at least one of a circumferential direction of the annular ring and a radial direction of the annular ring such that the carrier plate and the roller pin are offset from the shim plate in a direction opposite of the at least one of the circumferential direction and the radial direction.

According to a further aspect of the present disclosure, a method of adjusting a position of a plurality of variable vanes of a gas turbine engine includes arranging the plurality of variable vanes around a central axis of the gas turbine engine, arranging an annular ring radially outward of the central axis, and coupling the annular ring to the plurality of variable vanes. The method can further include arranging a carrier plate adjacent to the annular ring, the carrier plate having a roller pin coupled to a second carrier surface of the carrier plate opposite a first carrier surface, arranging a first shim plate between the carrier plate and the annular ring, the first shim plate sized so as to locate the roller pin a first predetermined distance from the annular ring so as to adjust a position of the plurality of variable vanes relative to the roller pin, and inserting a fastener axially through the annular ring, through the first shim plate, and through the carrier plate, a first portion of the fastener extending axially beyond the carrier plate. The method can further include arranging an adjustment plate on the second carrier surface of the carrier plate, the adjustment plate including an adjustment opening through which the first portion of the fastener extends when the adjustment plate is arranged on the carrier plate, and securing the first shim plate, the carrier plate, and the adjustment plate to the annular ring via a nut tightened against the adjustment plate on the first portion of the fastener.

In some embodiments, the adjustment plate is configured to be arranged on the carrier plate at a plurality of rotational positions therein relative to a central axis of the adjustment plate extending an axial direction relative to the annular ring, and the adjustment opening is offset from the central axis in a first direction that is at least one of a circumferential direction of the annular ring and a radial direction of the annular ring such that the carrier plate and the roller pin are offset from the shim plate in a second direction opposite the first direction, the second direction corresponding to a first rotational position of the adjustment plate.

In some embodiments, the method further includes removing the adjustment plate from the carrier plate and reinserting the adjustment plate on the carrier plate at a second rotational position different than the first rotational position such that the adjustment opening is offset from the central axis in a third direction different than the first direction such that the carrier plate and the roller pin are offset from the carrier plate in a fourth direction opposite the third direction.

In some embodiments, the method further includes removing the first shim plate from between the carrier plate and the annular ring and inserting a second shim plate between the carrier plate and the annular ring, the second shim plate having a thickness as measured in an axial direction relative to the annular ring different than the first shim plate so as to locate the roller pin at a second predetermined distance from the annular ring different than the first predetermined distance so as to adjust a position of the plurality of variable vanes relative to the roller pin.

These and other features of the present disclosure will become more apparent from the following description of the illustrative embodiments.

DETAILED DESCRIPTION OF THE DRAWINGS

Figure 1:
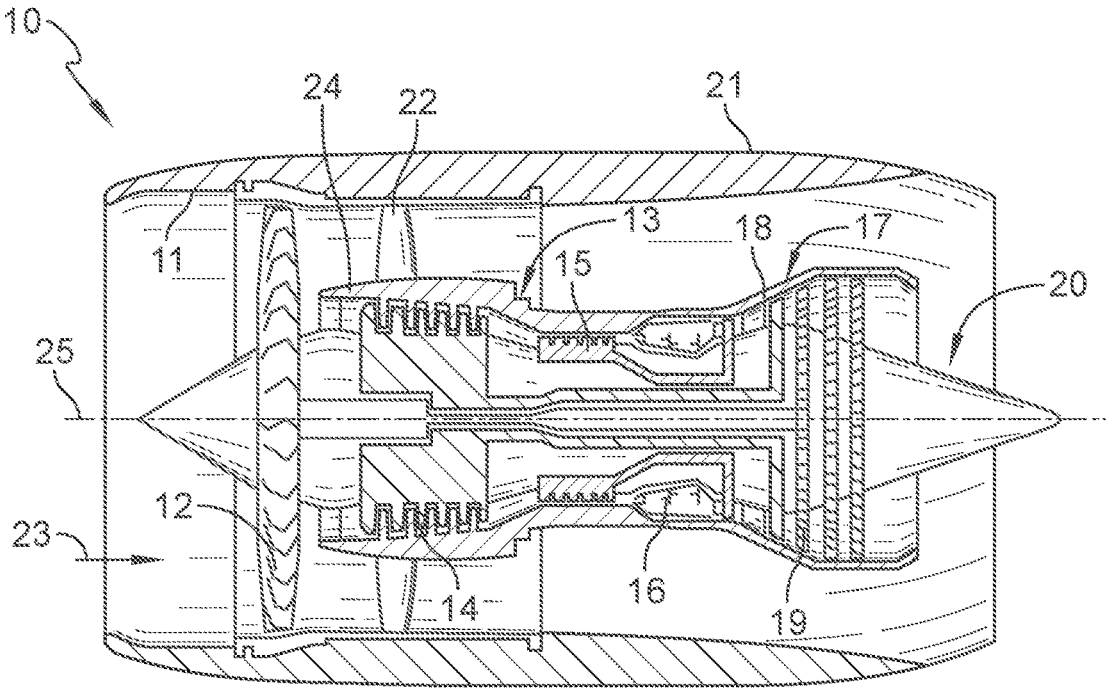
FIG. 1 is a cutaway view of a gas turbine engine with which a vane adjustment assembly according to the present disclosure may be utilized, showing that the gas turbine engine includes a propulsive fan, an engine core including a compressor, a combustor, and a turbine configured to drive the first propulsive fan, and a bypass duct surrounding the engine core.
Figure 2:
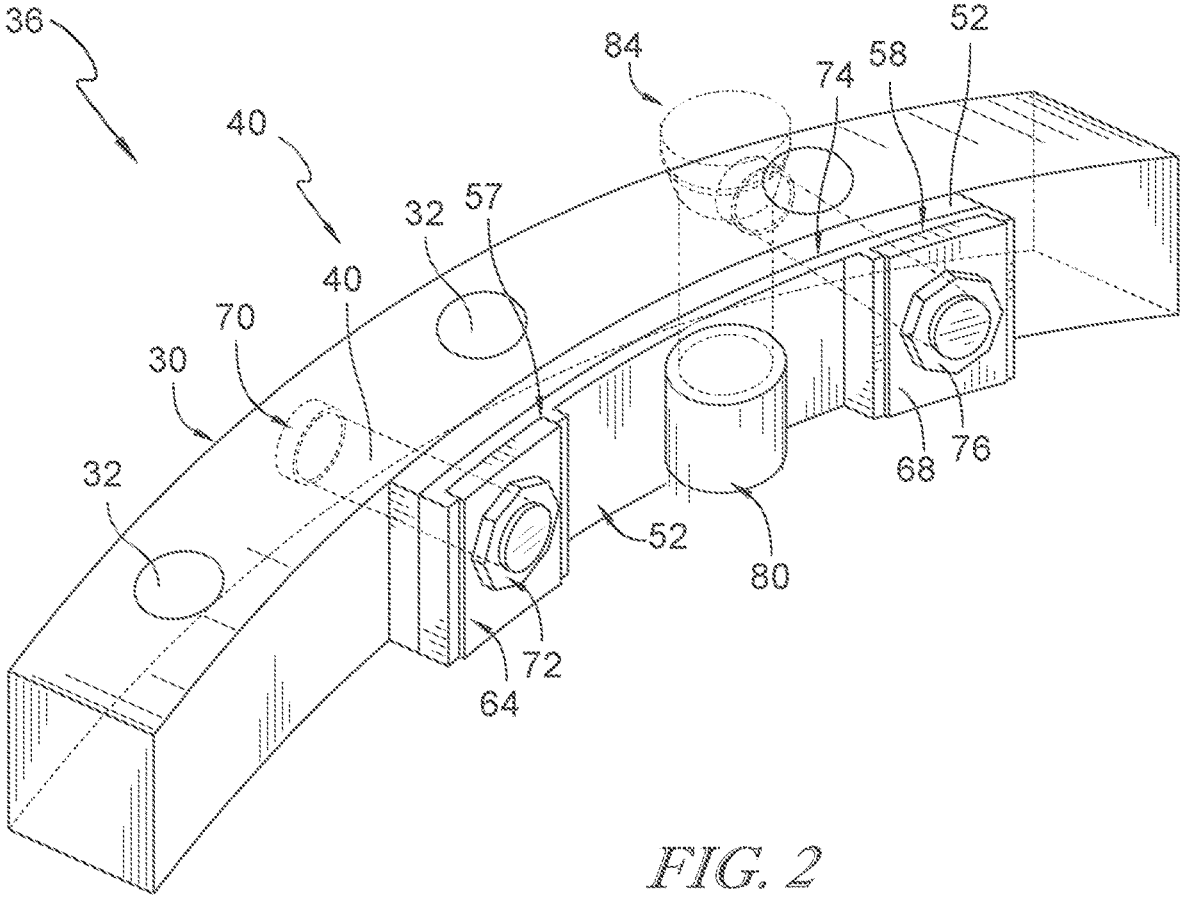
FIG. 2 is a perspective view of a vane adjustment assembly according to the present disclosure, showing that the assembly includes an annular ring and a ring adjustment assembly arranged on the annular ring, the ring adjustment assembly including a shim plate arranged on the annular ring, a carrier plate arranged on the shim plate, and adjustable plates arranged in recesses formed on the carrier plate, the carrier plate having a roller pin coupled thereto.

For the purposes of promoting an understanding of the principles of the disclosure, reference will now be made to a number of illustrative embodiments illustrated in the drawings and specific language will be used to describe the same.

The present disclosure is related to a vane adjustment assembly 36 configured to be utilized in a gas turbine engine 10, in particular a vane adjustment assembly 36 including a ring adjustment assembly 40 arranged on an annular ring 30 that is coupled to a plurality of variable vanes 26. The ring adjustment assembly 40 includes a shim plate 52 arranged on the annular ring 30, a carrier plate 56 arranged on the shim plate 52, and a roller pin 80 coupled to the carrier plate 56. The shim plate 52 is sized so as to locate the roller pin 80 at a predetermined distance from the annular ring 30 so as to adjust a position of the plurality of variable vanes 26 relative to the roller pin 80. The ring adjustment assembly 40 may further include an adjustment plate 64, 68 that can be arranged at a plurality of rotational positions so as to adjust the circumferential and/or radial position of the carrier plate 56 and thus the roller pin 80. A person skilled in the art will understand that the disclosed vane adjustment assembly 36 or any related vane adjustment assemblies may be utilized in any type of engine similar to a gas turbine engine or any turbomachinery including vanes.

A vane adjustment assembly 36 according to a first aspect of the present disclosure is shown in FIGS. 2 and 4-12B. In an illustrative embodiment, the vane adjustment assembly 36 is configured to be utilized in a turbofan gas turbine engine 10, as shown in FIG. 1. The exemplary gas turbine engine 10 includes an inlet 11, a fan 12, an engine core including a compressor 13 having an inter-stage compressor section 14 and a compressor discharge section 15, a combustor 16, and a turbine 17 having a high-pressure turbine 18 and a low-pressure turbine 19. The fan 12 is driven by the turbine 17 and provides thrust for forwardly propelling an aircraft on which the gas turbine engine 10 is coupled. The compressor 13 compresses and delivers air 23 to the combustor 16. The combustor 16 mixes fuel with the compressed air 23 received from the compressor 13 and ignites the fuel. The hot, high-pressure products of the combustion reaction in the combustor 16 are directed into the turbine 17 to cause the turbine 17 to rotate about an axis 25 of the gas turbine engine 10 and drive the compressor 13 and the fan 12 and exhaust remaining mixture out of the turbine 17 over an exhaust plug 20. The engine 10 may include a nacelle 21 that houses the engine components described above.

Figure 3A:
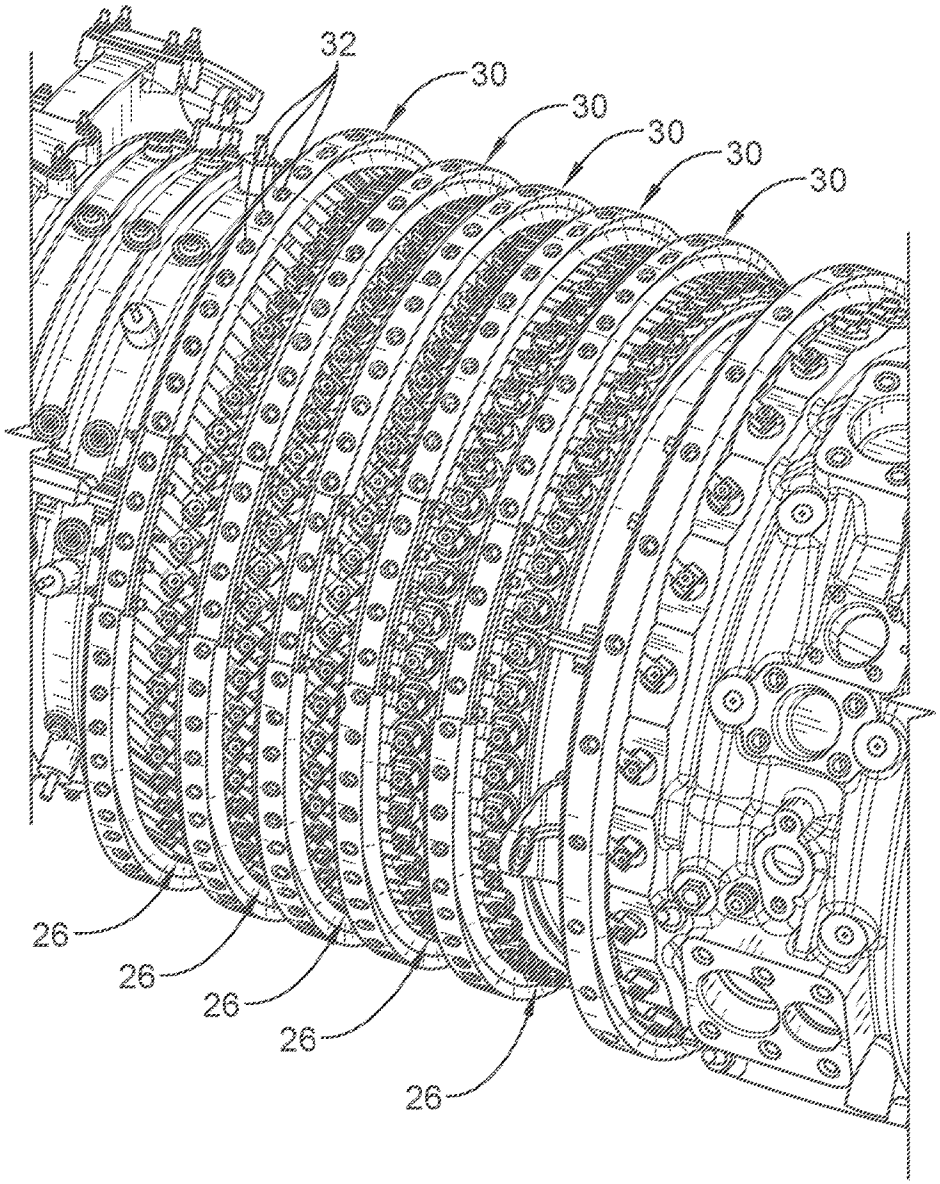
FIG. 3A is a perspective view of a compressor section of the engine of FIG. 1, showing that the engine includes multiple annular rings associated with adjacent vane stages of the compressor section, each annular ring being coupled to an associated plurality of vanes of each vane stage so as to control the associated plurality of variable vanes.

The engine 10 includes a casing 24, which may be formed as a single component or multiple cojoined components, that surrounds the various sections of the engine 10, including the compressor 13, the combustor 16, and the turbine 17. Illustratively, the compressor 13 and/or turbine 17 sections may include multiple stages of a plurality of vanes 26 arranged between stages of bladed rotors, as shown in FIG. 3A. In an exemplary embodiment, the compressor section 13 of the engine 10 may include multiple stages, in particular five stages as shown in FIG. 3A, of pluralities of vanes 26, each surrounded by an annular ring 30.

Figure 3B:
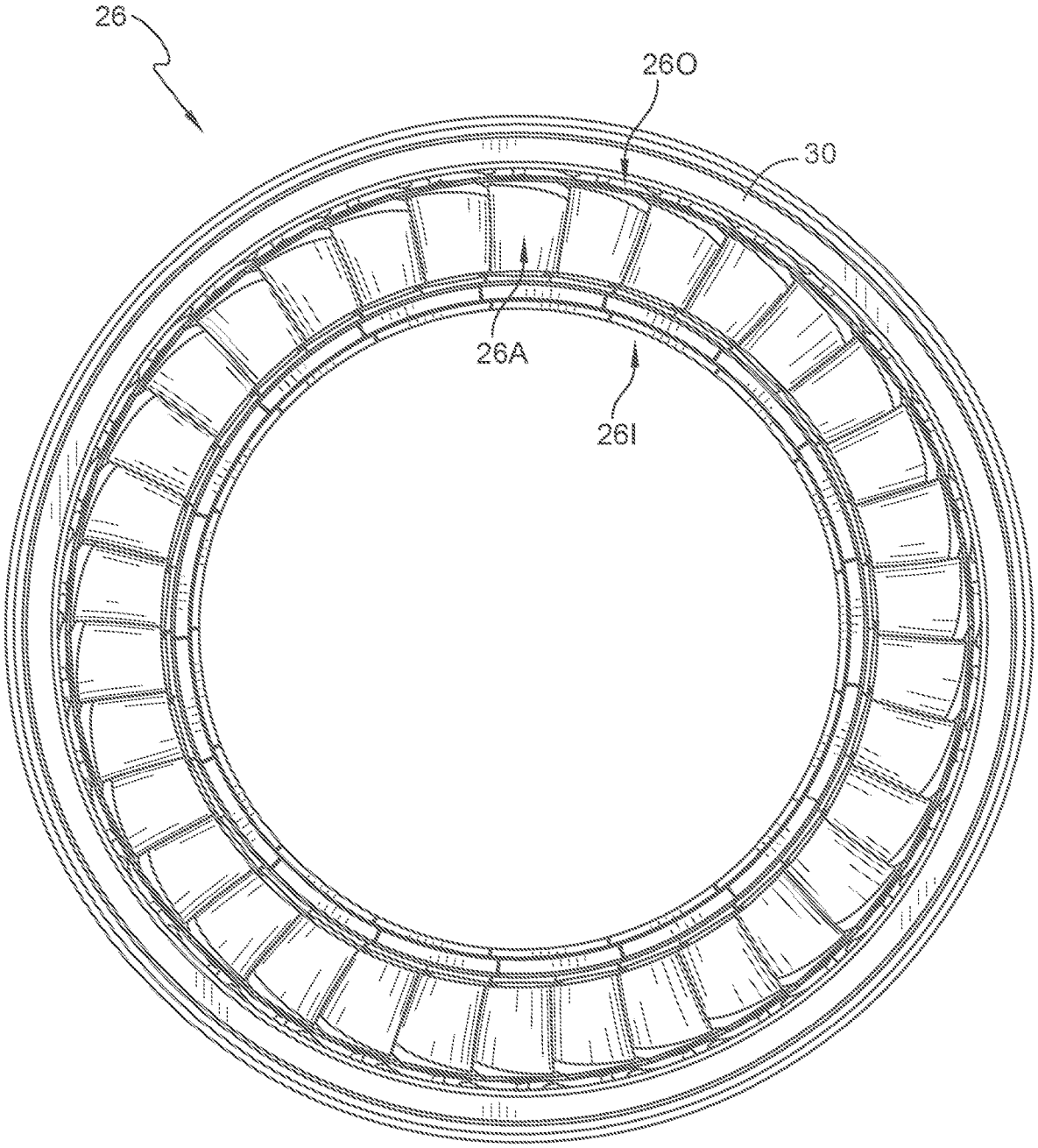
FIG. 3B is a front view of a plurality of vanes of a vane stage of the vane assembly of FIG. 3A.

In some embodiments, the plurality of vanes 26 include individual vane airfoils 26A having inner and outer platforms 261, 260, as shown in FIG. 3B. The plurality of vanes 26 may be surrounded by an annular ring 30. At least some or all of the vanes of the plurality of vanes 26 in some or all of the stages described above may be variable vanes that are configured to rotate so as to selectively redirect incoming air exiting an axially forward bladed rotor and subsequently onto other components of the engine 10.

In the illustrative embodiment, the vane adjustment assembly 36 is configured to be utilized in the compressor or turbine sections 13, 17 of the engine 10, although in other embodiments, a person skilled in the art could envision the adjustment assembly 36, or any other vane assemblies described herein, being utilized in other sections of the engine 10, such as with variable fan outlet guide vanes 22 arranged downstream of the fan 12 or inlet guide vanes arranged upstream of the fan 12.

Figure 3C:
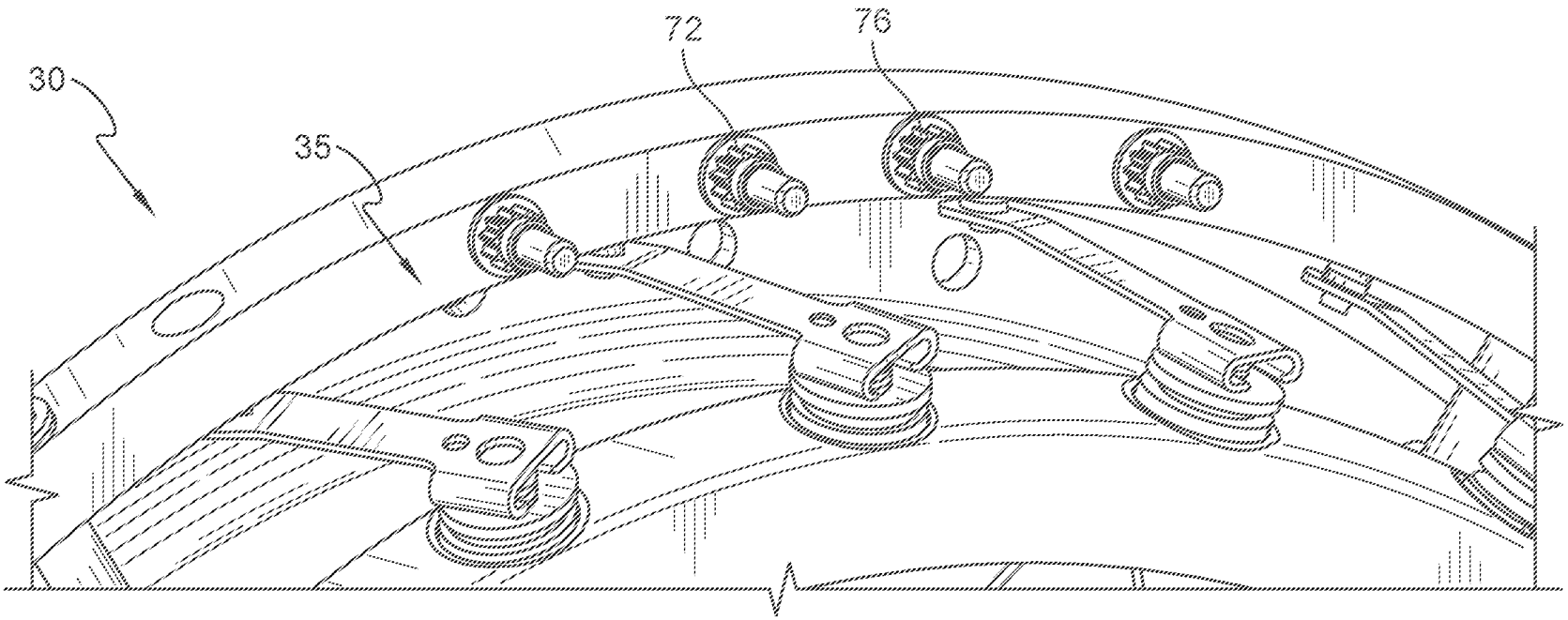
FIG. 3C is a perspective view of the annular ring and plurality of vanes on which the vane adjustment assembly of FIG. 2 is arranged, showing the annular ring coupled to each vane of the plurality of vanes via an actuator lever and a bearing coupled to a radially outer end of the vane.

FIG. 3C shows a perspective view of the annular ring 30, in particular the axially facing surface 35 of the annular ring 30 on which the vane adjustment assembly 36 can be arranged. In other embodiments, the assembly may be arranged on the axially facing surface of the annular ring 30 opposite the axially facing surface 35. The annular ring 30 can be coupled to each vane of the plurality of vanes 26 via an actuator lever 27 that is rotatably coupled to the annular ring 30 at an attachment hole 32 of the ring 30 and a bearing 28 coupled to a radially outer end of the vane. Movement of the annular ring 30, in particular circumferentially or axially, will affect the positioning of the plurality of vanes 26. In some embodiments, the rings 30 and vanes 26 are moved as the engine power and operating environment changes, such as between take-off, cruise, landing, etc. or between different temperatures, altitudes, pressures, etc.

Illustratively, the annular ring 30 is formed as a fully annular ring that is movably or slidably arranged relative to the casing 24 so as to rotate annularly relative thereto, as shown in FIG. 3A. The annular ring 30 may be formed as a single monolithic component, or may be formed in sections that are coupled together to form the fully annular ring 30. As can be seen in FIG. 3A and FIG. 3B, the annular ring 30 is arranged axially aft relative to the plurality of vanes 26, although a person skilled in the art will understand that, in other embodiments, the ring 30 may be arranged axially forward of the plurality of vanes 26. In some embodiments, the annular ring 30 is coaxial with the plurality of vanes 26, and more specifically, with the central axis 25.

Figure 3D:
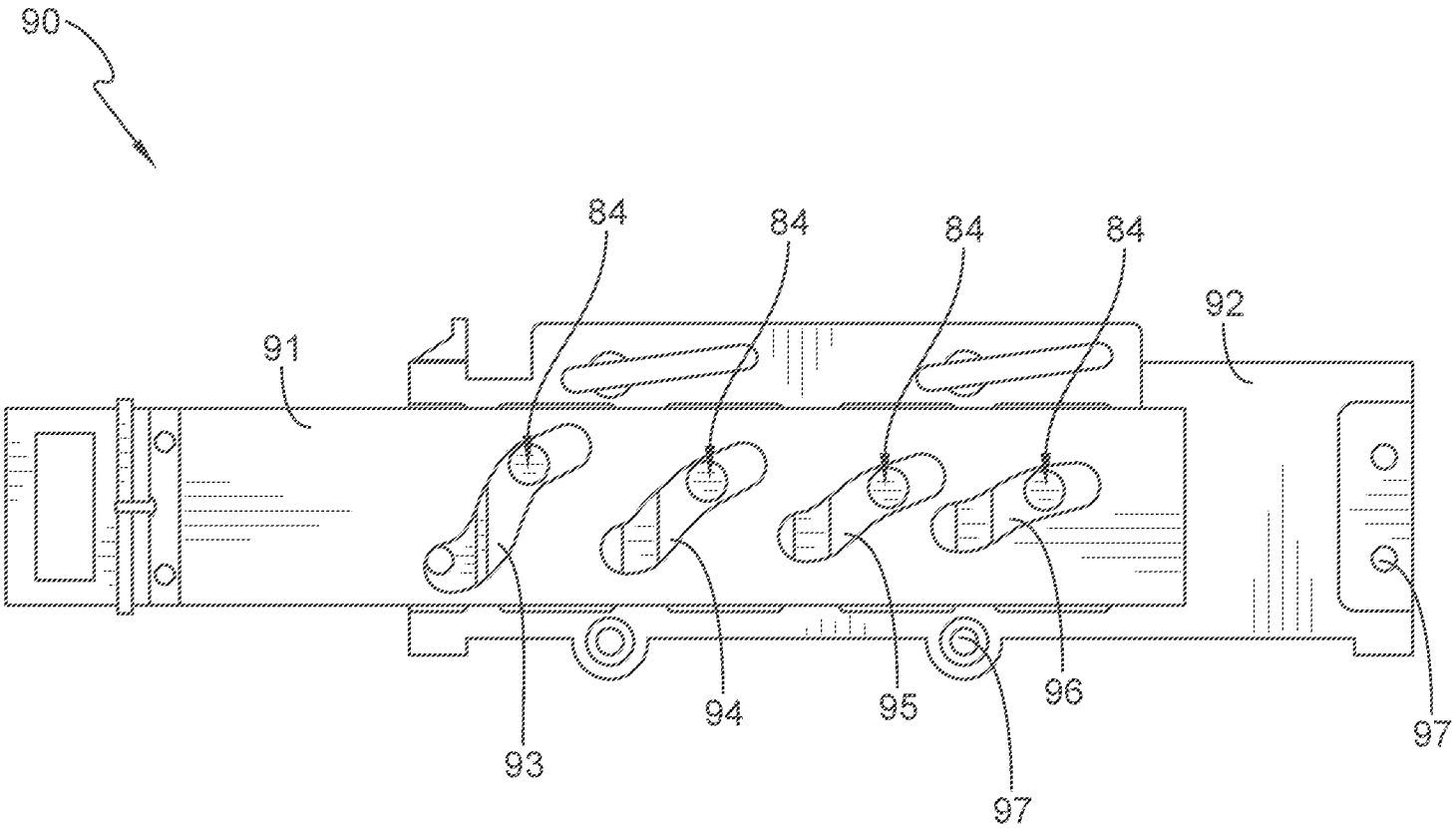
FIG. 3D is a top view of a cam plate configured to slidably engage the roller pin of the vane adjustment assembly of FIG. 2, showing that the cam plate is slidable in the axial direction relative to the casing so as to move the roller pins within slots formed in the cam plate.

As shown in FIG. 3D, a cam plate assembly 90 may be utilized to movably couple the vane adjustment assembly 36 to the casing 24. The cam plate assembly 90 includes a slidable cam plate 91 and a stationary support plate 92 fixedly coupled to the casing 24 at fastening points 97. The cam plate 91 may be slidably coupled to the support plate 92 either on a radially outer side of the support plate 92, as shown in FIG. 3D, or on a radially inner side of the support plate 92.

The cam plate 91 includes a plurality of slots 93, 94, 95, 96 which, when the cam plate 91 is arranged on the support plate 92, are aligned with the individual vane stages, for example, shown in FIG. 3A. The roller pin 80 of the vane adjustment assembly 36 of each vane stage is slidably arranged within each the corresponding slot 93, 94, 95, 96 via a roller pin head 84. The slots 93, 94, 95, 96 may be include the same or varying elongated shapes configured provide the same or differing movement paths for the roller pin heads 84 engage the roller pin head 84 of the vane adjustment assembly 36. In operation, the cam plate 91 can be moved in the axial direction relative to the stationary support plate 92, and thus relative to the casing 24, so as to move the roller pin heads 84 within the slots 93, 94, 95, 96 and thus along the specific paths defined by the slots 93, 94, 95, 96. The movement of the roller pin heads 84 will in turn move the annular ring 30 that is coupled to the roller pins 80 via the vane adjustment assembly 36.

With the cam plate 91, the roller pin 80 of the vane adjustment assembly 36 may be moved to a plurality of distinct roller pin positions that, in addition to each corresponding to an axial thickness of the shim plate 52 and a circumferential and/or radial position of the carrier plate 80, each further correspond to distinct positions of the roller pin 80 relative to the casing 24. Moreover, due to the roller pin 80 being coupled to the annular ring 30 via the carrier plate 56, the movement of the roller pin 80 relative to the casing 24 via the cam plate 91 will also affect the positioning of the annular ring 30 relative to the casing 24.

In order to further fine-tune and adjust the positioning of the plurality of vanes 26 via the positioning of the annular ring 30, the vane adjustment assembly 36 further includes the ring adjustment assembly 40 shown in FIGS. 2 and 4-12B. Illustratively, the ring adjustment assembly 40 includes a shim plate 52 arranged on the annular ring 30, a carrier plate 56 having the roller pin 80 fixedly coupled thereto, and adjustment plates 64, 68.

Figure 4A:
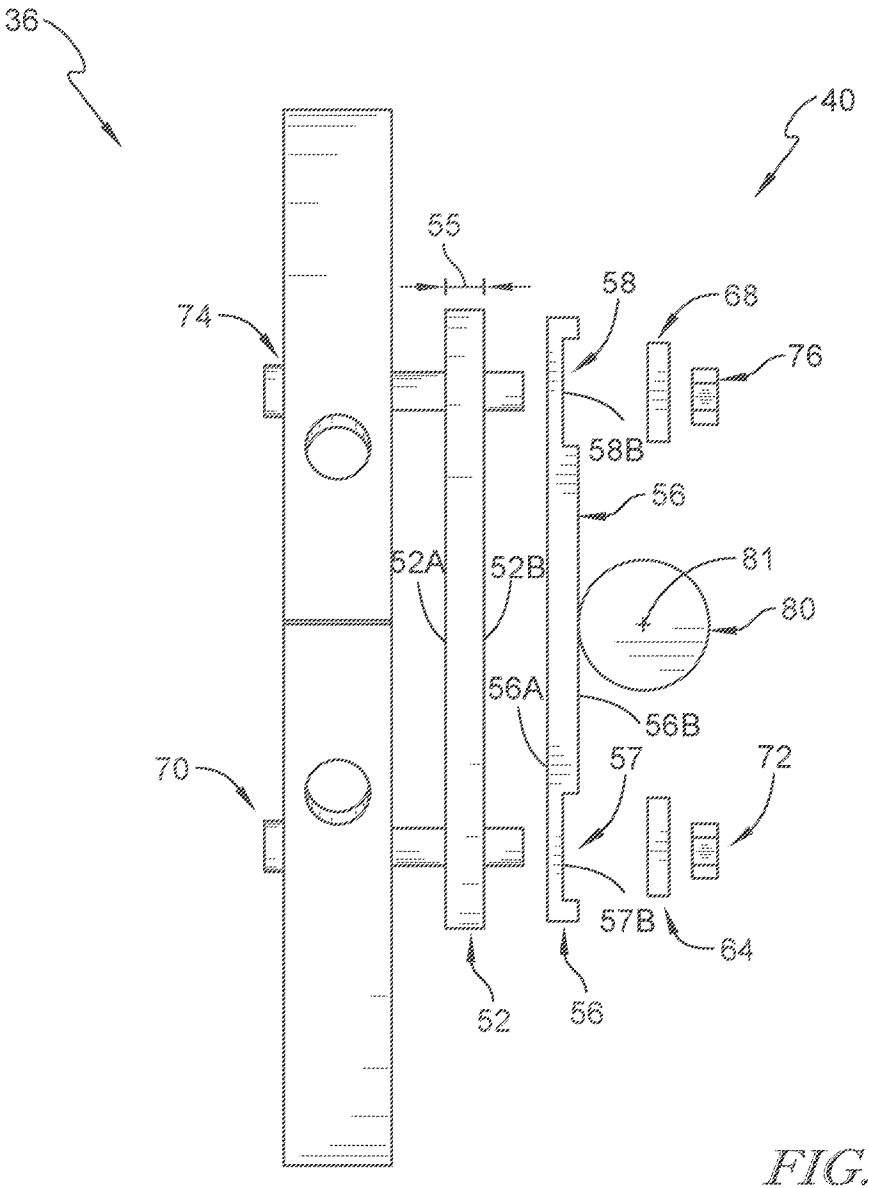
FIG. 4A is a top exploded view of the vane adjustment assembly of FIG. 2, showing the shim plate, the carrier plate having the roller pin, and the adjustment plates, and showing that fasteners extend through the annular ring and through the plates to couple the assembly to the annular ring.
Figure 5A:
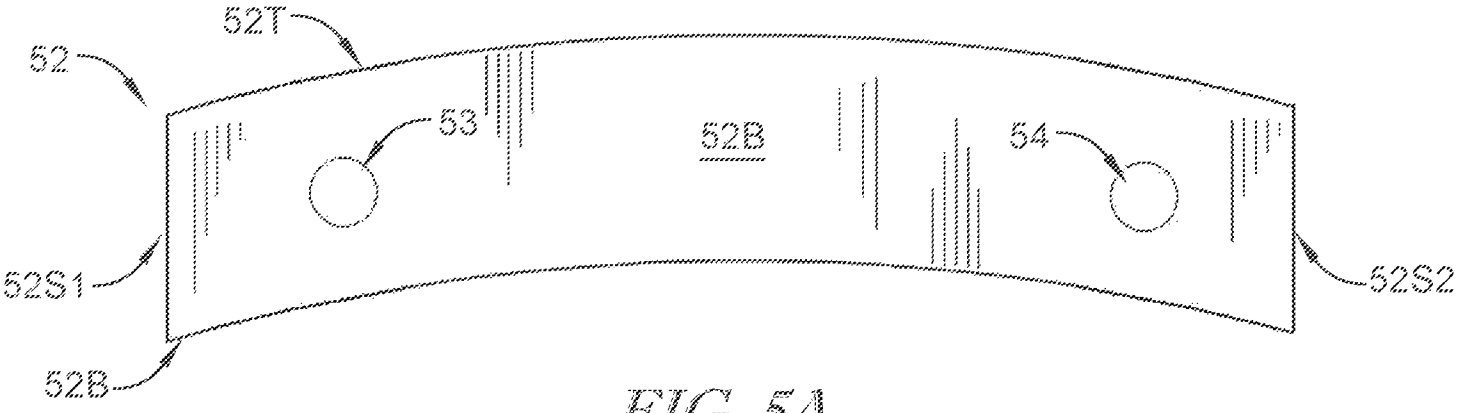
FIG. 5A is a rear view of the shim plate of the vane adjustment assembly of FIG. 4A, showing that the shim plate includes holes formed therethrough for insertion of the fasteners.

As can be seen in FIGS. 4A and 5A, the shim plate 52 is formed as a flat plate that is configured to be arranged on the axially facing surface 35 of the annular ring 30. In some embodiments, the shim plate 52 may be formed to be generally rectangular, although a person skilled in the art will understand that other shapes may be utilized so long as the plate 52 can be arranged between the annular ring 30 and the carrier plate 56. Illustratively, the top side 52T and the bottom side 52B of the shim plate 52 are curved to substantially match the curvature of the annular ring 30. The shim plate 52 is configured to be arranged on the annular ring 30 on a first shim surface 52A facing the ring 30 opposite a second shim surface 52B, as shown in FIG. 4A.

Figure 4B:
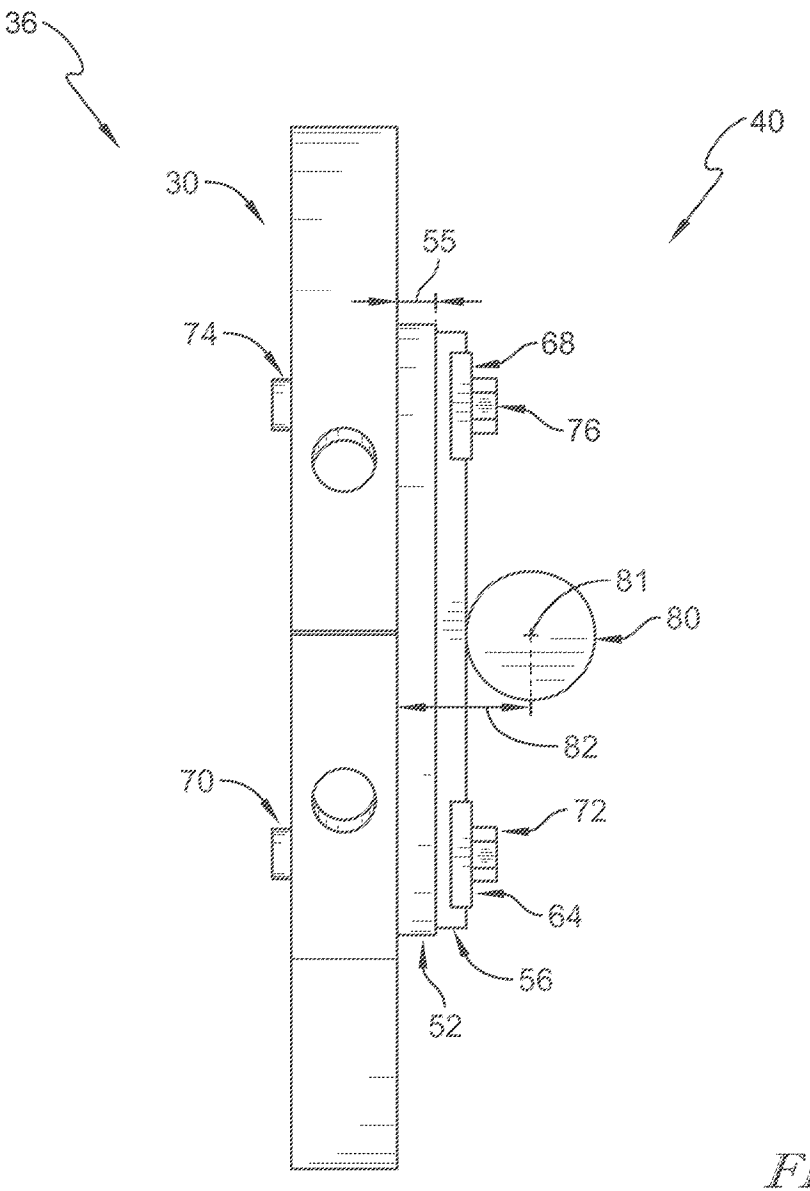
FIG. 4B is top view of the vane adjustment assembly of FIG. 4A, showing the shim plate, the carrier plate having the roller pin, and the adjustment plates coupled to the annular ring via the fasteners.

In the illustrative embodiment, the shim plate 52 has a thickness 55 as measured in the axial direction relative to the annular ring 30, as shown in FIGS. 4A and 4B. In particular, the shim plate 52 is configured to be removably arranged on either axially facing surface of the annular ring 30, in particular on the axially facing surface 35 in the illustrative embodiment, via fasteners 70, 74 extending through two spaced apart holes 53, 54, respectively, formed in the shim plate 52. The holes 53, 54 are arranged toward opposing circumferential sides 52S1, 52S2 of the shim plate 52, as shown in FIG. 5A.

The roller pin 80 is coupled to the second surface 56B of the carrier plate 56 and extends radially outward away from the carrier plate 56, as shown in FIGS. 4A-6. The roller pin 80 may be formed as a cylinder 82 that extends upwardly and terminates at a roller pin head 84, which is located at a radially outer terminal end of the roller pin cylinder 82. As described above, the roller pin head 84 is configured to move within the slots 93, 94, 95, 96 formed in the cam plate 91. In some embodiments, the roller pin 80 is centrally aligned on the second surface 56B.

As can be seen in FIG. 4B, the thickness 55 of the shim plate 52 locates the central axis 81 of the roller pin 80 at an axial distance 82 from the annular ring 30. As a result, by adjusting the position of the roller pin 80, the positioning of the annular ring 30 can be adjusted relative to the roller pin 80. Moreover, because the roller pin 80 is movably coupled to the casing 24, the positions of the annular ring 30 can be adjusted relative to the casing 24 as well. As will be described in greater detail below with reference to FIGS. 12A and 12B, different sized shim plates may be utilized with the ring adjustment assembly 40, such as the shim plate 152 shown in FIGS. 12A and 12B having a larger thickness 155 than the thickness 55 of the shim plate 52 of FIGS. 4A-10C. As a result of the larger thickness 155, the shim plate 152 locates the central axis 81 of the roller pin 80 at an axial distance 182 from the annular ring 30 that is larger than the axial distance 82 described above.

Figure 5B:
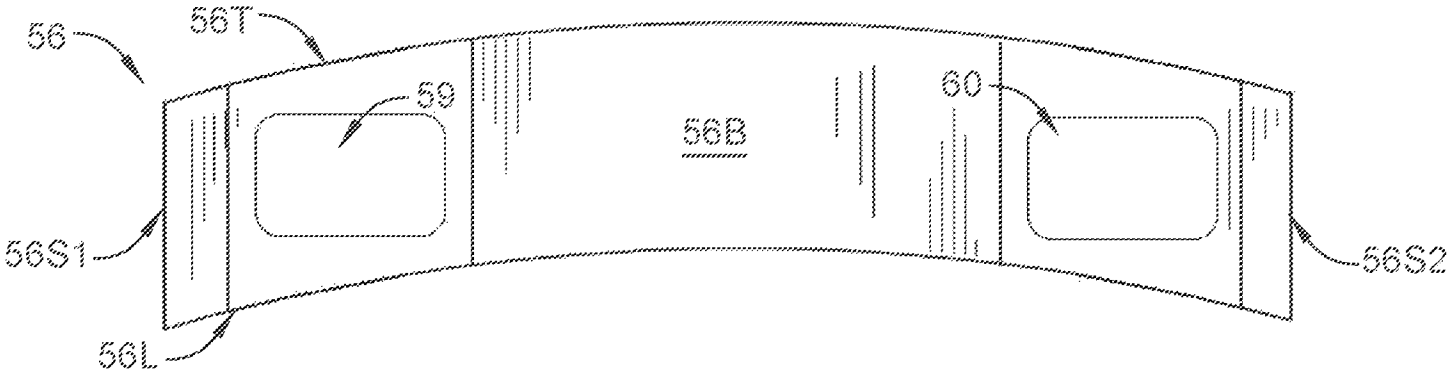
FIG. 5B is a rear view of the carrier plate of the vane adjustment assembly of FIG. 4A, showing that the carrier plate includes elongated holes formed therethrough for insertion of the fasteners, the elongated holes being enlarged in the circumferential and radial directions for circumferential and radial adjustment of the carrier plate based on the specific rotational position of the adjustment plates.

The ring adjustment assembly 40 further includes the carrier plate 56, as shown in detail in FIGS. 4A, 4B, and 5B. The carrier plate is formed similar to the shim plate 52, in particular formed as a flat plate that is configured to be arranged on the second shim surface 52B of the shim plate 52. In some embodiments, the carrier plate 56 may be formed to be generally rectangular, although a person skilled in the art will understand that other shapes may be utilized so long as the plate 56 can be arranged on the second shim surface 52B of the shim plate 52. Illustratively, the top side 56T and the lower side 56L of the carrier plate 56 are curved to substantially match the curvature of the annular ring 30 and the shim plate 52. The carrier plate 56 is arranged on the shim plate 52 on a first carrier surface 56A opposite a second carrier surface 56B, as shown in FIG. 4A.

The carrier plate 56 is configured to be removably arranged on the second shim surface 52B of the shim plate 52 via the fasteners 70, 74 extending through two spaced apart openings 59, 60, respectively, formed in the carrier plate 56. The openings 59, 60, also referred to as first and second openings, are arranged toward opposing circumferential sides 56S1, 56S2 of the carrier plate 56, as shown in FIG. 5B. The openings 59, 60 are formed generally centrally between side surfaces 57S, 58S of the recesses 57, 58.

Figure 6:
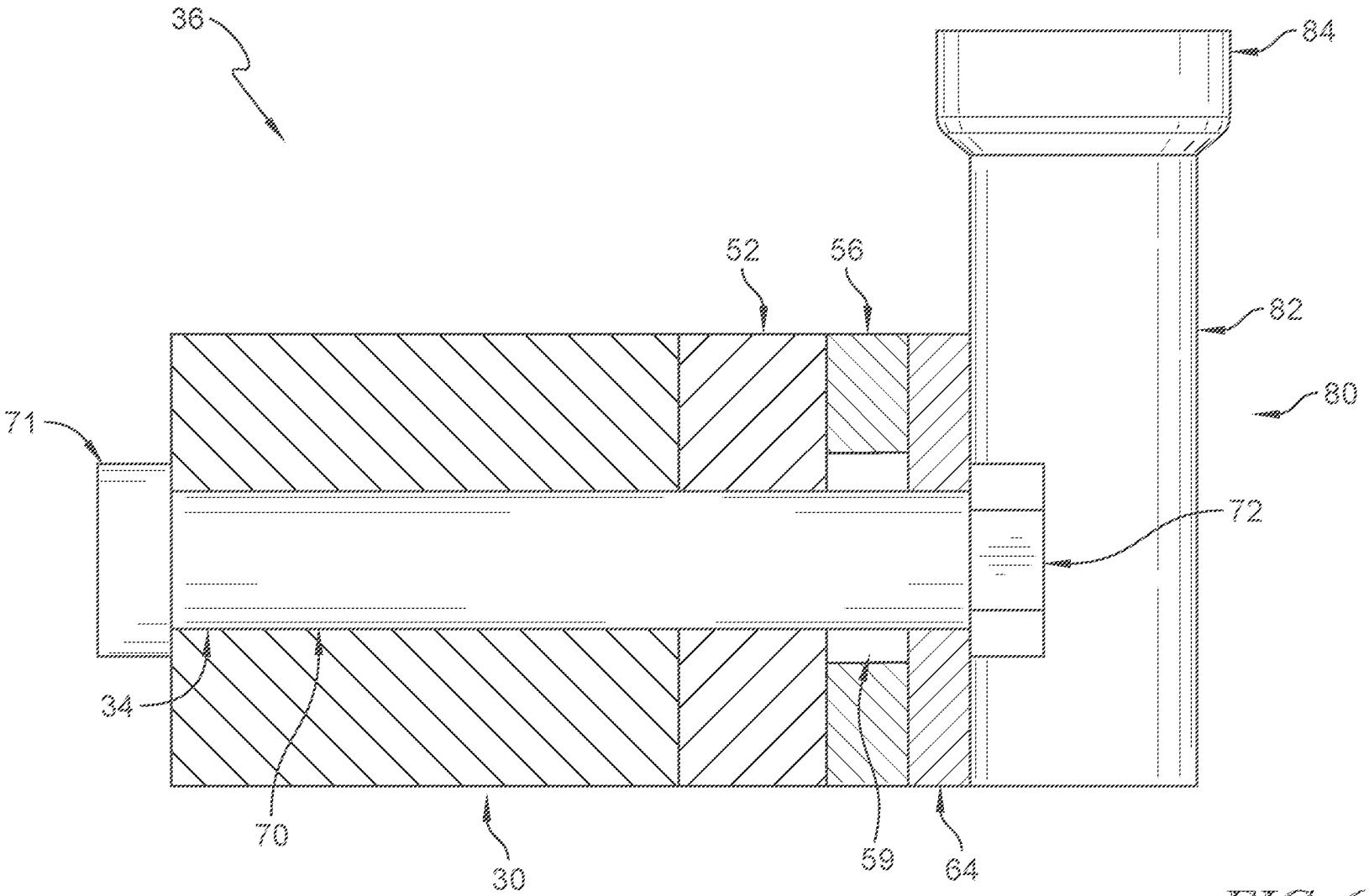
FIG. 6 is a side cross-sectional view of the vane adjustment assembly of FIG. 2.

As also shown in FIG. 5B and as will be described in greater detail below, the openings 59, 60 are formed to be elongated in both the radial and circumferential directions so as to accommodate the various rotational positions of the adjustment plates 64, 68. In some embodiments, the openings 59, 60 may extend further in the circumferential direction than in the radial direction, as shown in FIGS. 5B and 6. In some embodiments, the openings 59, 60 may be rectangular and include curved corners. In some embodiments, the openings 59, 60 may be formed as large holes that are large enough to allow the fastener 70, 74 to extend through the openings 53, 54 and subsequently through the openings 65, 69 of the adjustment plate 64, 68 in all rotational positions of the adjustment plates 64, 68.

As can be seen in FIGS. 4A and 4B, the carrier plate 56 further includes recesses 57, 58 formed in the second carrier surface 56B. The recesses 57, 58 are spaced apart in the circumferential direction and are aligned with the openings 59, 60. In other words, the openings 59, 60 are formed in a bottom surfaces 57B, 58B of the recesses 57, 58, respectively. Each recess 57, 58 opens axially outwardly away from the annular ring 30, as shown in FIGS. 4A and 4B. In some embodiments, the carrier plate 56 includes more or less than two recesses 57, 58, such as 1, 3, 4, or 5 recesses.

As shown in FIGS. 4A and 4B, the adjustment plates 64, 68 are removably arranged in the recesses 57, 58 of the carrier plate 56. As can be seen in greater detail in FIGS. 7-10B, 10D, and 11A-11I, the adjustment plates 64, 68 include adjustment openings 65, 69 formed therethrough in the axial direction relative to the annular ring 30. The adjustment plates 64, 68 may be formed as squares, but a person skilled in the art will understand that other shapes may be utilized so long as the offset of the adjustment openings 65, 69 causes the carrier plate 56 to be offset from the shim plate 52 when the adjustment plates 64, 68 are arranged in the recesses 57, 58.

The fasteners 70, 74 extend through the openings 59, 60 and through the adjustment openings 65, 69, as shown in FIGS. 4A and 4B. As can be seen in FIG. 4B, the fasteners 70, 74 extend beyond the second carrier surface 56B of the carrier plate 56 such that nut 72, 76 may be fastened to the terminal end of the fastener 70, 74 so as to secure the shim plate 52, the carrier plate 56, and the adjustment plates 64, 68 to the annular ring 30.

Figure 12A:
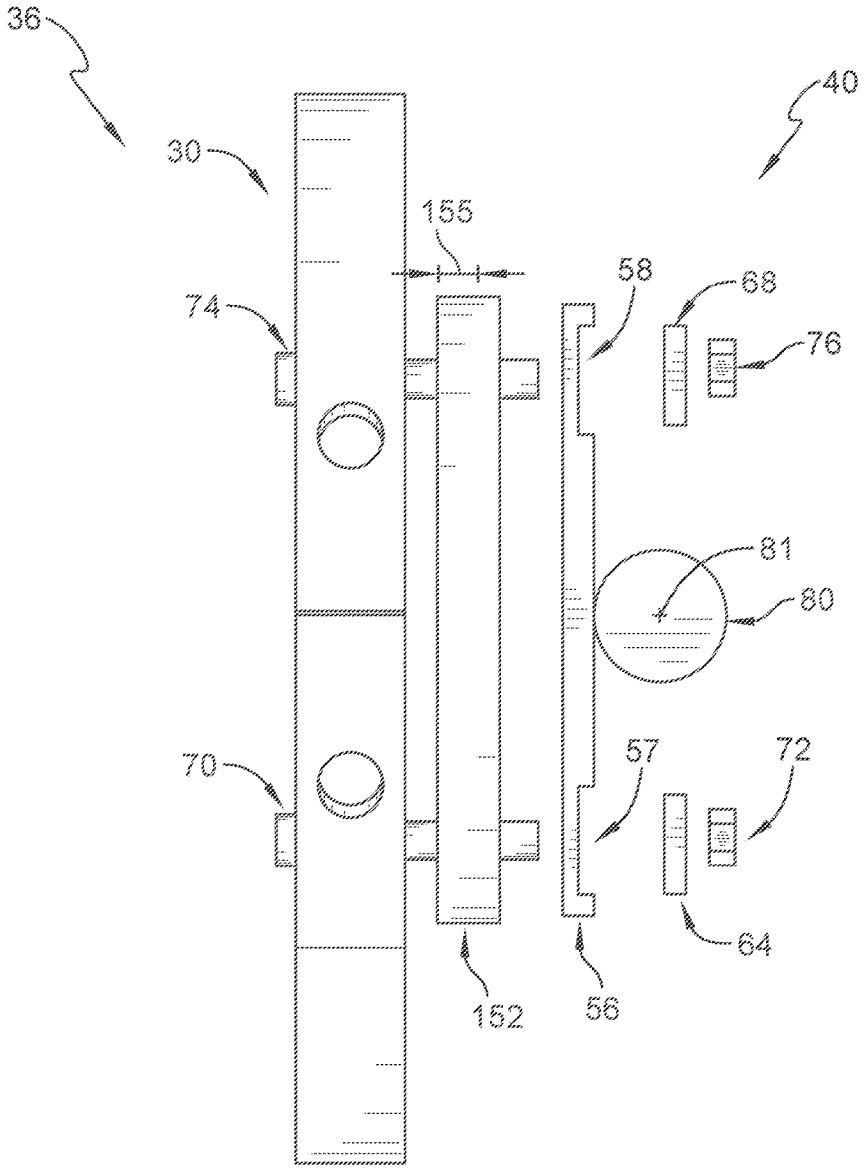
FIG. 12A is a top exploded view of a vane adjustment assembly according to a further aspect of the present disclosure, showing the shim plate, the carrier plate having the roller pin, and the adjustment plates, showing that fasteners extend through the annular ring and through the plates to couple the assembly to the annular ring, and showing that the shim plate is axially thicker than the shim plate of the embodiment shown in FIG. 2.
Figure 12B:
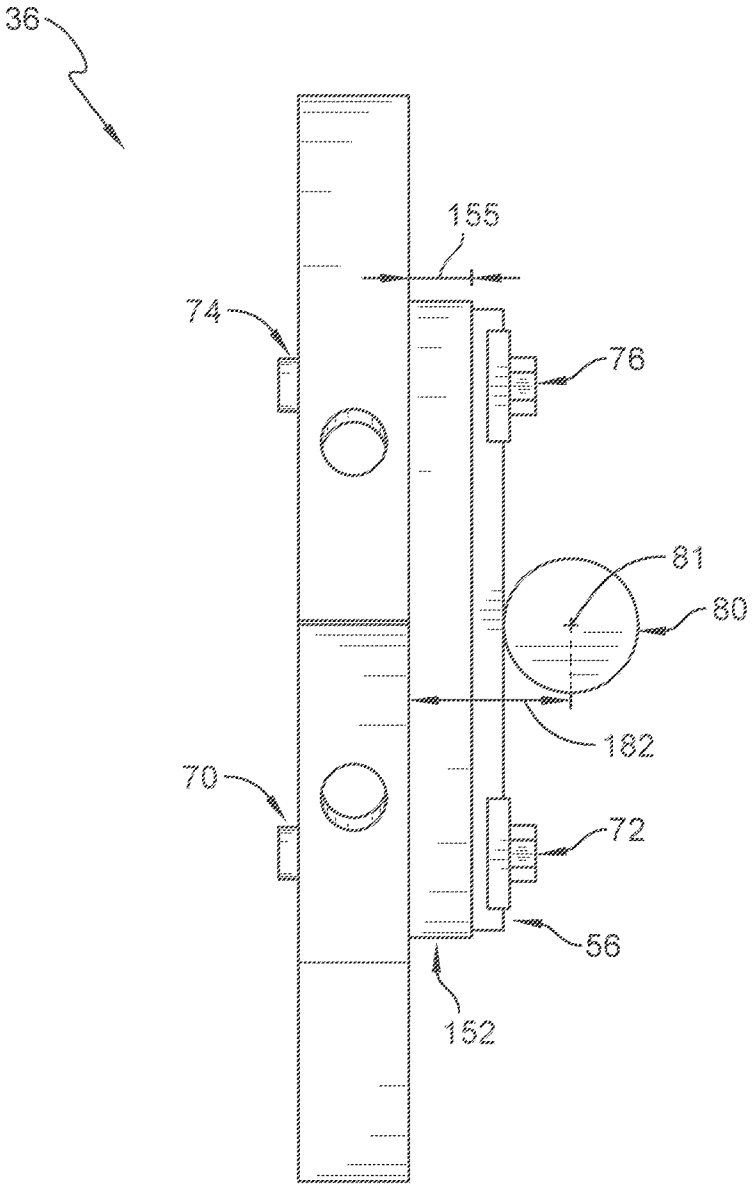
FIG. 12B is top view of the vane adjustment assembly of FIG. 12A, showing the shim plate, the carrier plate having the roller pin, and the adjustment plates coupled to the annular ring via the fasteners.

The adjustment plates 64, 68 are sized such that at least one side 64S, 68S of the adjustment plates 64, 68 contact one or both of the side surfaces 57S, 58S of the recesses 57, 58, as shown, for example, in FIGS. 4B and 12B. As a result of this contact, as will be described in greater detail below, any offset of the adjustment openings 65, 69 relative to a side 64S, 68S of the adjustment plate 64, 68 will cause the corresponding side surface 57S, 58S that contacts the side 64S, 68S to also be offset relative to a central axis of the corresponding fastener 70, 74. As a result, the carrier plate 56 will be offset from the shim plate 52.

Figure 7:
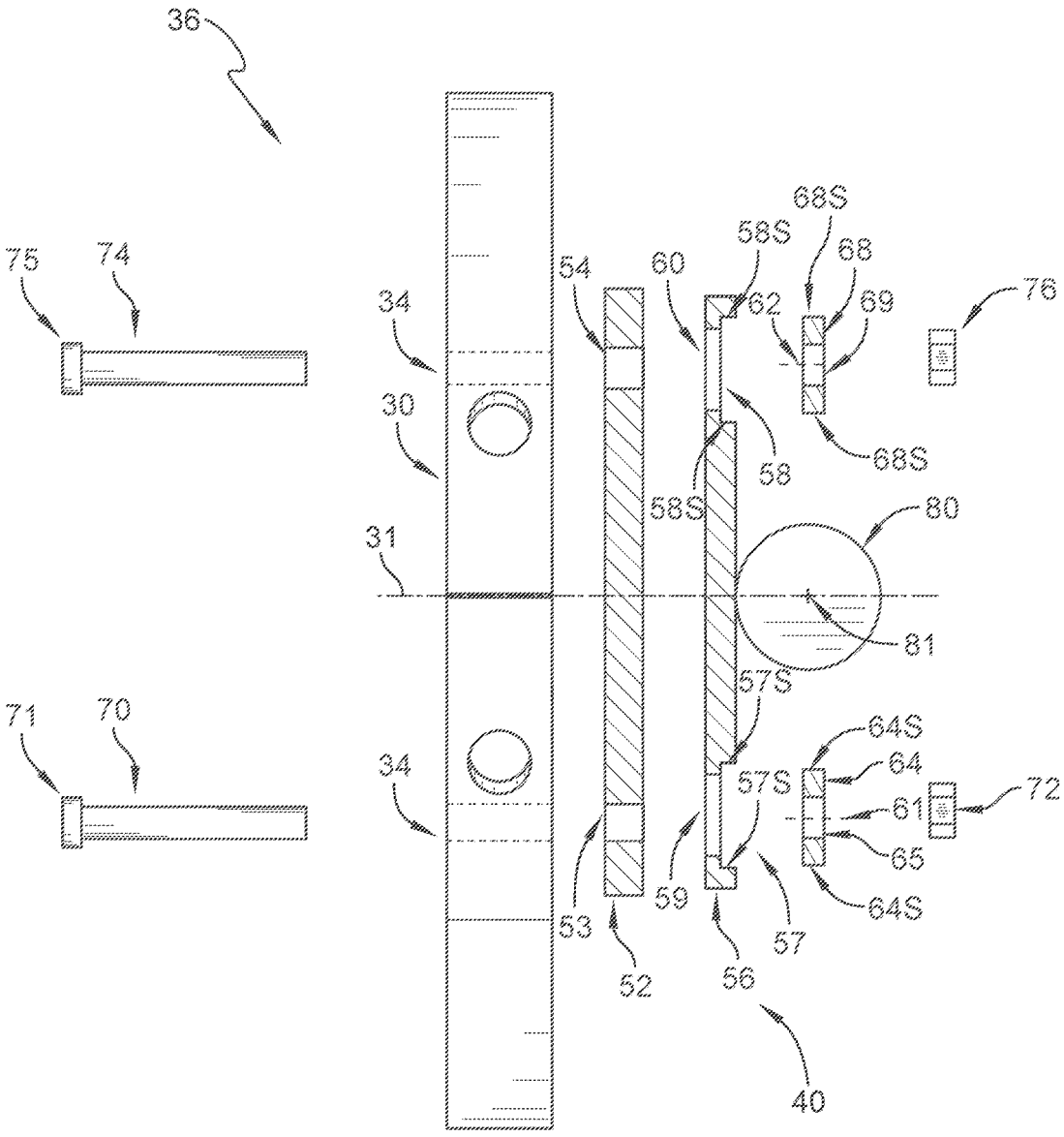
FIG. 7 is a top cross-sectional exploded view of the vane adjustment assembly of FIG. 2, showing the shim plate, the carrier plate having the roller pin, and the adjustment plates, and showing that fasteners extend through the annular ring and through the plates to couple the assembly to the annular ring.
Figure 11A:
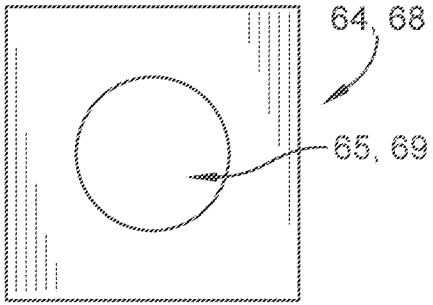
FIG. 11A is a rear view of an adjustment plate of the vane adjustment assembly of FIG. 2, showing the hole centered relative to the adjustment plate.
Figure 11B:
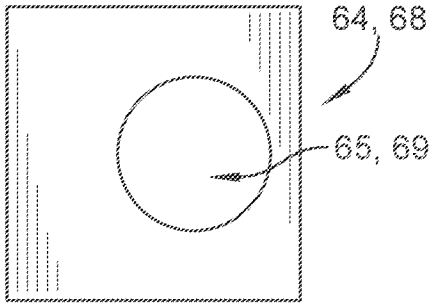
FIG. 11B is a rear view of an adjustment plate of the vane adjustment assembly of FIG. 2, showing the hole offset in a first circumferential direction relative to the annular ring.
Figure 11C:
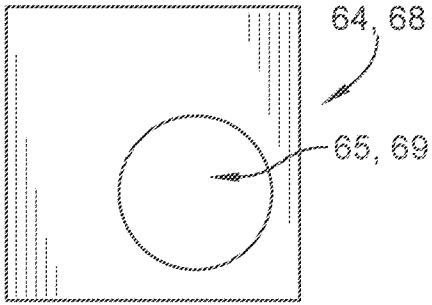
FIG. 11C is a rear view of an adjustment plate of the vane adjustment assembly of FIG. 2, showing the hole offset in a first radial direction that is radially inward relative to the annular ring and offset in the first circumferential direction.
Figure 11D:
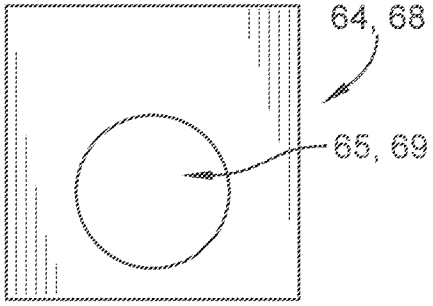
FIG. 11D is a rear view of an adjustment plate of the vane adjustment assembly of FIG. 2, showing the hole offset in the first radial direction.
Figure 11E:
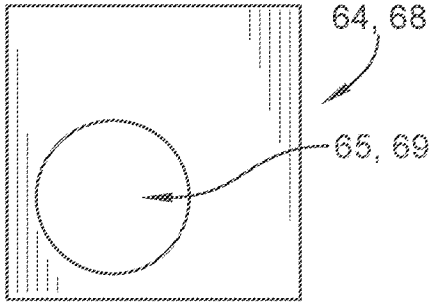
FIG. 11E is a rear view of an adjustment plate of the vane adjustment assembly of FIG. 2, showing the hole offset in the first radial direction and offset in a second circumferential direction opposite the first circumferential direction.
Figure 11F:
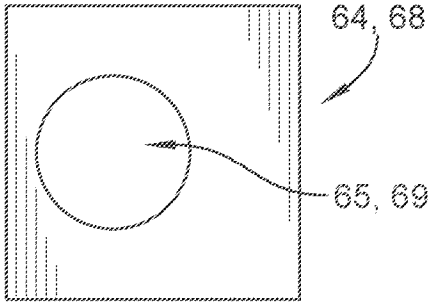
FIG. 11F is a rear view of an adjustment plate of the vane adjustment assembly of FIG. 2, showing the hole offset in the second circumferential direction.
Figure 11G:
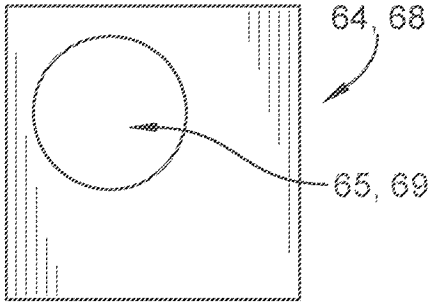
FIG. 11G is a rear view of an adjustment plate of the vane adjustment assembly of FIG. 2, showing the hole offset in the second circumferential direction and a second radial direction opposite the first radial direction.
Figure 11H:
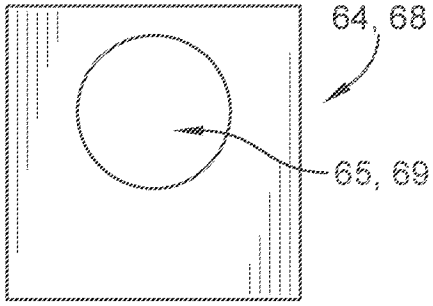
FIG. 11H is a rear view of an adjustment plate of the vane adjustment assembly of FIG. 2, showing the hole offset in the second radial direction.
Figure 11I:
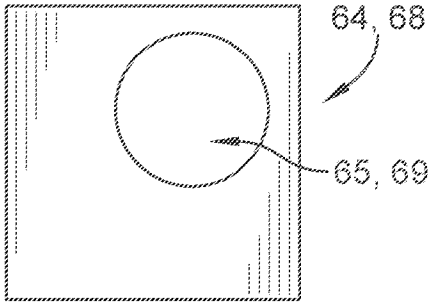
FIG. 11I is a rear view of an adjustment plate of the vane adjustment assembly of FIG. 2, showing the hole offset in the second radial direction and the first circumferential direction.

As shown in FIGS. 7 and 11A, the adjustment openings 65, 69 of the adjustment plates 64, 68 can be centrally located relative to the outer perimeter (sides 64S, 68S) of the adjustment plates 64, 68. In some embodiments, the adjustment plates 64, 68 can be arranged within the recesses 57, 58 such that the two opposing circumferentially facing sides 64S, 68S of the adjustment plates 64, 68 contact the side surfaces 57S, 58S of the recesses 57, 58. In other words, the adjustment plates 64, 68 are sized to be slide-fit into the recesses 57, 58. Because the adjustment openings 65, 69 are located equidistant from the two opposing circumferentially facing sides 64S, 68S of the adjustment plate 64, 68, and because these sides 64S, 68S contact the side surfaces 57S, 58S of the recesses 57, 58, the carrier plate 56 is aligned with the shim plate 52 circumferentially. As a result, the central axis 81 of the roller pin 80 is aligned with a central point of the shim plate 52 (shown as axis 31 in FIG. 7), and thus is also centrally aligned with a center point of the annular ring 30 that the axis 31 extends through.

In order to offset the carrier plate 56 in the circumferential direction relative to the shim plate 52, and thus relative to the annular ring 30, the adjustment plates 64, 68 include adjustment openings 65, 69 that are offset from a central axis 61, 62 of the adjustment plate 64, 68 that extends in the axial direction relative to the annular ring 30, as shown, in FIGS. 8-11I. The adjustment openings 65, 69 are offset from the central axis 61, 62 of the first adjustment plate 64, 68 in at least one of a circumferential direction of the annular ring 30 and a radial direction of the annular ring 30.

Figure 8:
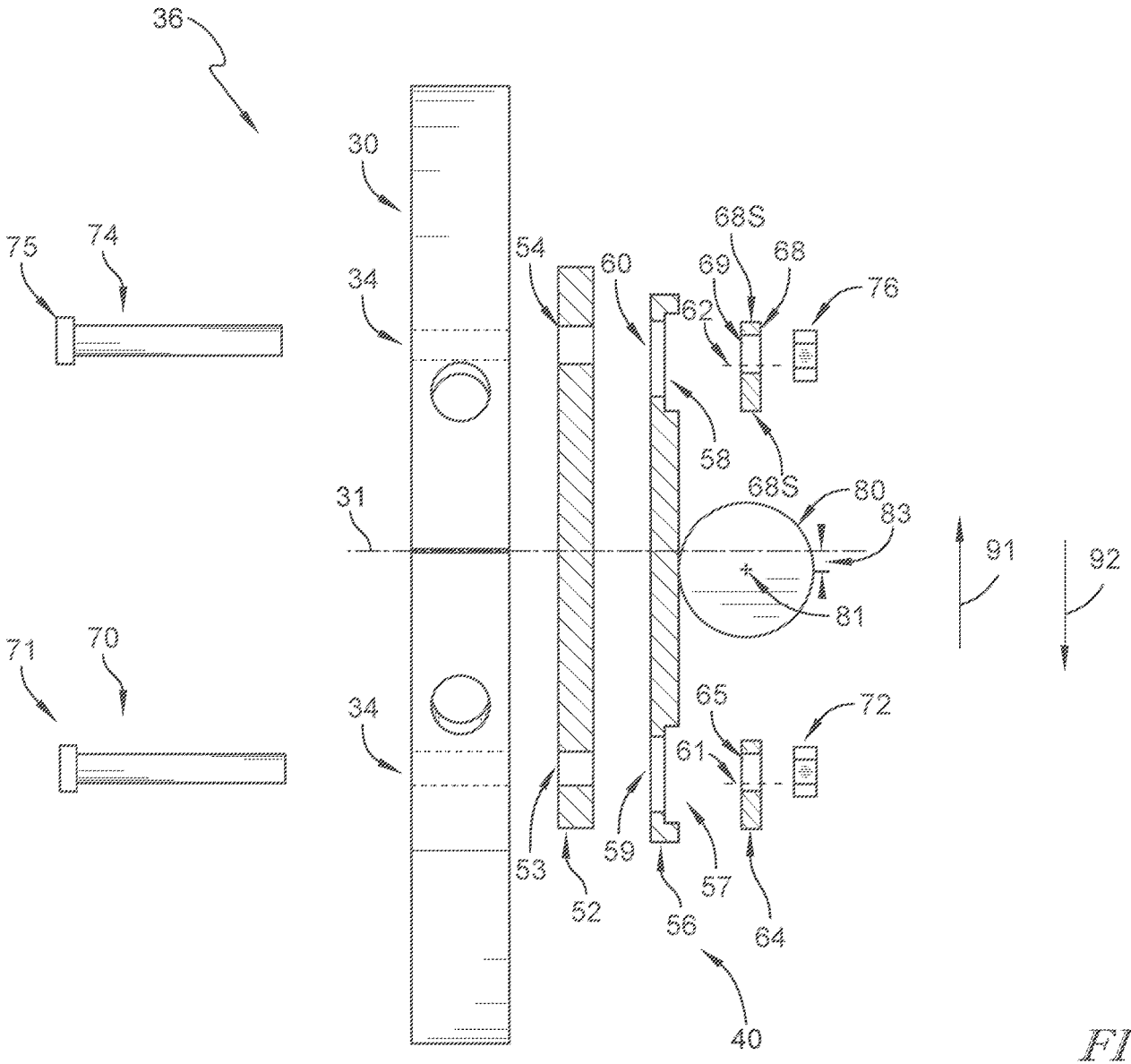
FIG. 8 is a top cross-sectional exploded view of the vane adjustment assembly of FIG. 7, showing the adjustment plates at a first rotational position that adjusts the carrier plate in a first circumferential direction.
Figure 9A:
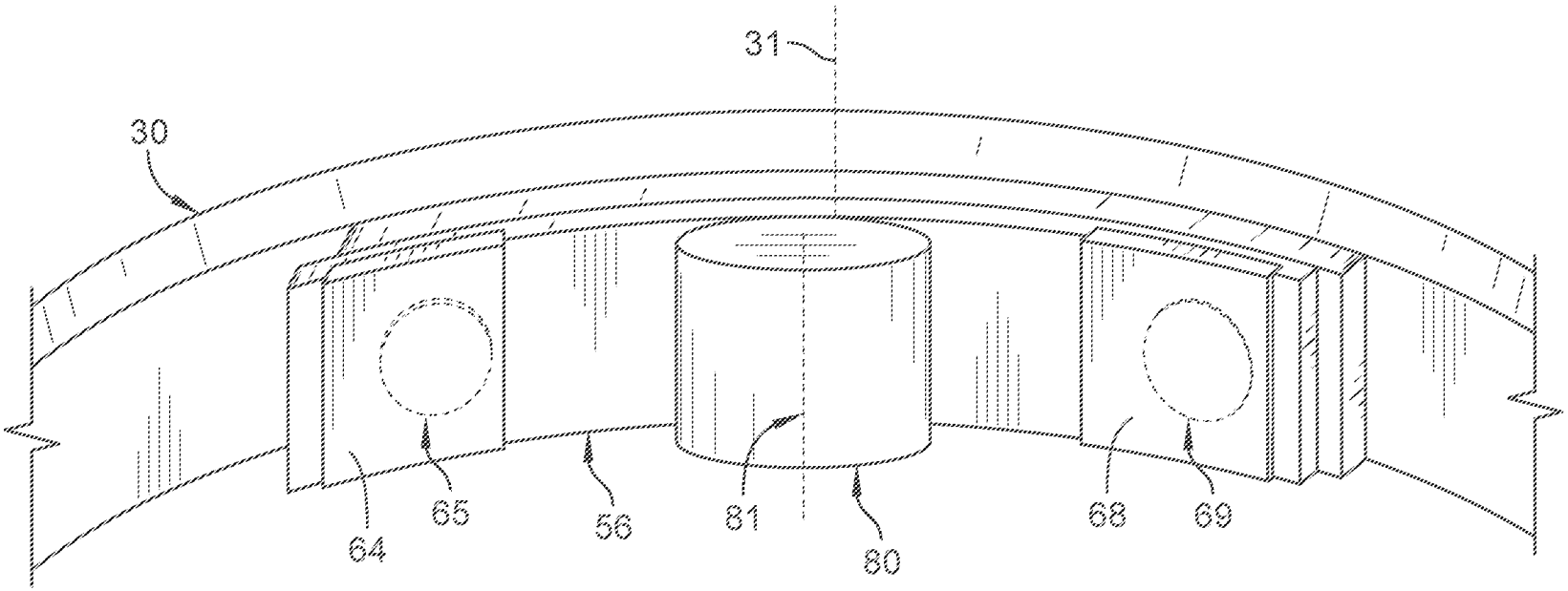
FIG. 9A is a rear perspective view of the vane adjustment assembly of FIG. 8, showing the adjustment plates at a first rotational position that adjusts the carrier plate in the first circumferential direction.
Figure 9C:
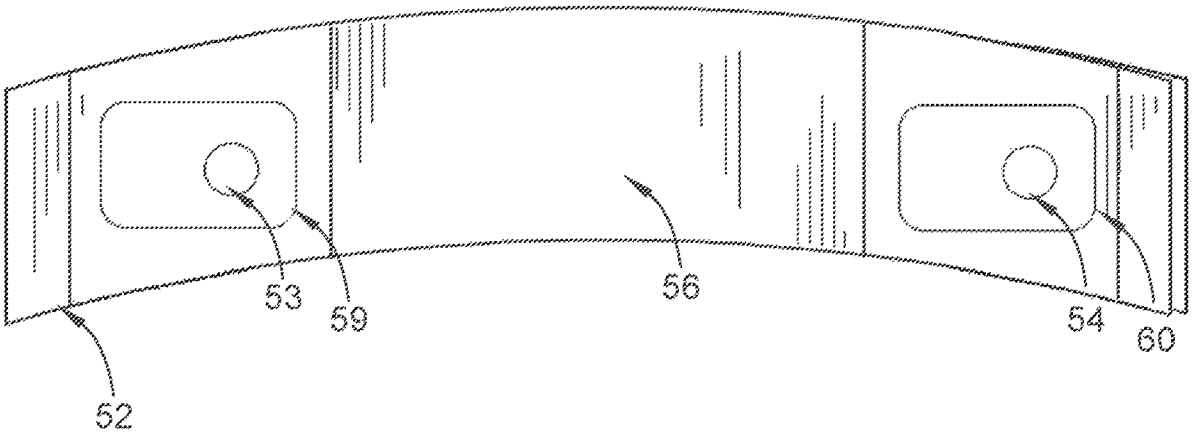
FIG. 9C is a rear view of the shim plate and the carrier plate positions corresponding to the first rotational position of the adjustment plate shown in FIG. 9B.
Figure 9B:
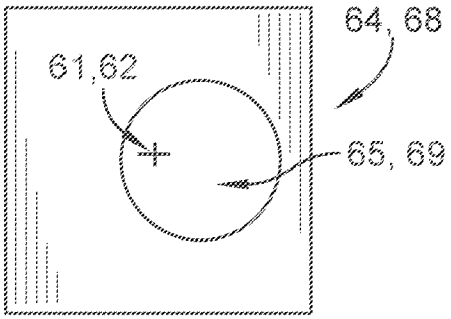
FIG. 9B is a rear view of an adjustment plate of the vane adjustment assembly of FIG. 8 corresponding to the positions of the shim plate and the carrier plate shown in FIG. 9C, showing the adjustment plate at the first rotational position that adjusts the carrier plate in the first circumferential direction.

By way of a non-limiting example, as shown in FIGS. 8-9C, the adjustment openings 65, 69 are offset from the central axis 61, 62 of the first adjustment plate 64, 68 in a first circumferential direction 91. As a result, the central axis 61, 62 of each plate 64, 68 is offset in the second circumferential direction 92 opposite the first circumferential direction 91. Because the sides 64S, 68S contact the side surfaces 57S, 58S of the recesses 57, 58, the offset causes the carrier plate 56 to be offset in the second circumferential direction 92 relative to the shim plate 52, and thus relative to the annular ring 30. As a result, the central axis 81 of the roller pin 30 is offset from the center axis 31 by a an offset distance 83. FIGS. 9B and 9C show a rear view in the axial direction of the adjustment openings 65, 69 of the plates 64, 68 offset in the first circumferential direction 91 and the positioning of the openings 53, 54, 59, 60 of the shim plate 52 and carrier plate 56 when the adjustment plate 64, 68 is arranged at this rotational position.

Figure 10A:
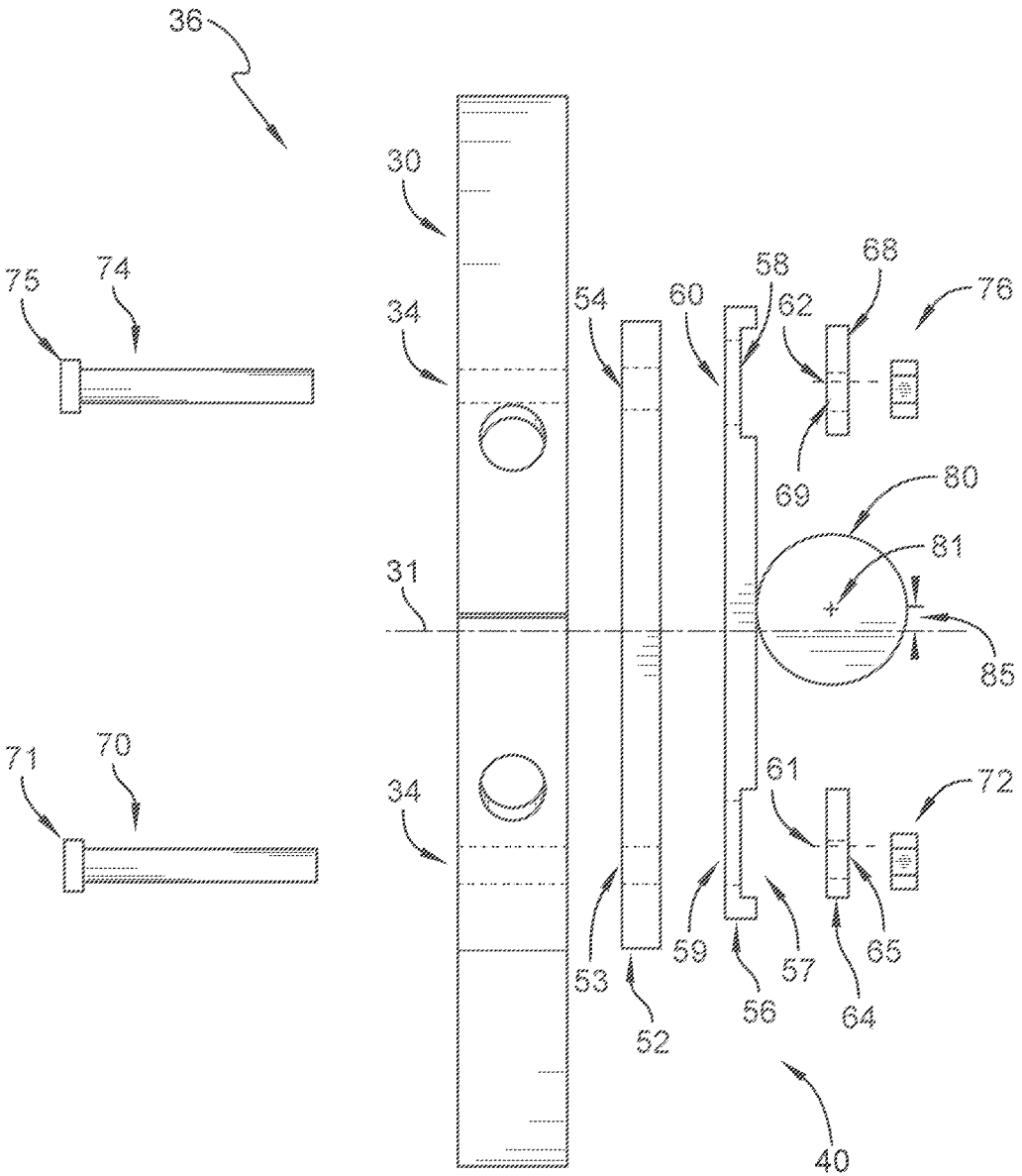
FIG. 10A is a rear perspective view of the vane adjustment assembly of FIG. 8, showing the adjustment plates at a second rotational position that adjusts the carrier plate in a second circumferential direction.

In order to further adjust the offset of the carrier plate 56 relative to the shim plate 52, the adjustment plates 64, 68 can be selectively arranged within the recesses 57, 58 at a plurality of rotational positions therein relative to the central axis 61, 62. For example, the adjustment plates 64, 68 described with regard to FIG. 8 can be removed from the recesses 57, 58, flipped 180 degrees such that the offset is in the opposite direction (i.e. the second circumferential direction 92), and reinserted and secured in the recesses 57, 58. This arrangement is shown in FIG. 10A, in which the adjustment openings 65, 69 of the adjustment plates 64, 68 are now offset in the second circumferential direction 92 such that the carrier plate 56 is offset from the shim plate 52 and thus the annular ring 30 in the first circumferential direction 91. As a result, the central axis 81 of the roller pin 80 is offset from the central axis 31 in the first circumferential direction 91 by an offset distance 85.

Figure 10C:
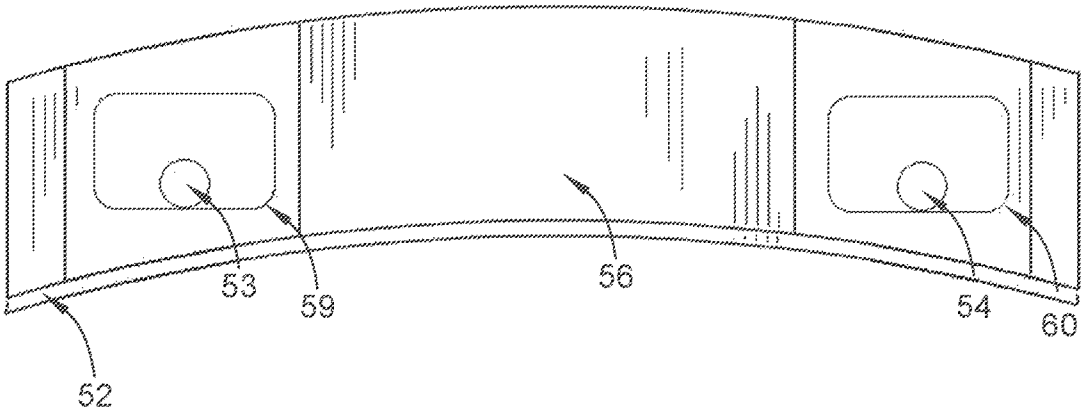
FIG. 10C is a rear view of the shim plate and the carrier plate positions corresponding to the third rotational position of the adjustment plate shown in FIG. 10B.
Figure 10B:
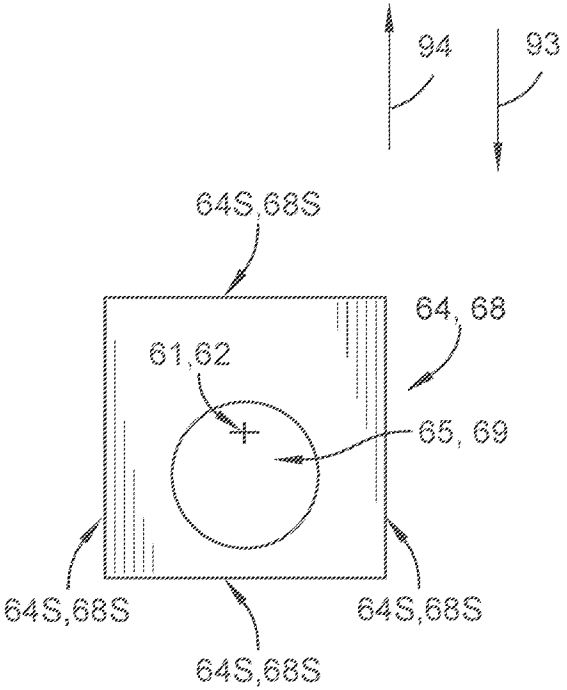
FIG. 10B is a rear view of an adjustment plate of the vane adjustment assembly of FIG. 2 corresponding to the positions of the shim plate and the carrier plate shown in FIG. 10C, showing the adjustment plate at a third rotational position that adjusts the carrier plate in a first radial direction.

As shown in FIGS. 10B and 10C, the carrier plate 56 can be adjusted to be offset relative to the shim plate 52 in the radial direction. For example, the adjustment plates 64, 68 described with regard to FIG. 8 can be removed from the recesses 57, 58, flipped 90 degrees such that the offset is in a first radial direction 93, and reinserted and secured in the recesses 57, 58. In this arrangement, the adjustment openings 65, 69 of the adjustment plates 64, 68 are now offset in the first radial direction 93 such that the carrier plate 56 is offset from the shim plate 52 and thus the annular ring 30 in the second radial direction 94. As a result, the roller pin 80 is offset from the central axis 31 in the second radial direction 94, or in other words, located further radially outward than the embodiment shown in FIGS. 7-10A. The same rotation of the adjustment plates 64, 68 can be carried out in the opposite direction, i.e. the openings 65, 69 being offset in the second radial direction 94 such that the carrier plate 56 is offset from the shim plate 52 in the first radial direction 93. The larger size of the openings 59, 60 allow for the radial offsets in addition to the circumferential offsets.

FIGS. 11A-11I show non-limiting examples of offset positions of the adjustment openings 65, 69 of the adjustment plates 64, 68. FIG. 11A shows a centrally located adjustment opening 65, 69. FIGS. 11B, 11D, 11F, and 11H show entirely circumferential or radial offsets of the adjustment opening 65, 69. These offsets may be achieved by rotating the adjustment plate 64, 68 of FIG. 11B to the positions shown in FIGS. 11D, 11F, and 11H. FIGS. 11C, 11E, 11G, and 11I show offsets that are partially offset in the circumferential direction and partially offset in the radial direction, or in other words, located in the corners of the adjustment plates 64,68. These offsets may be achieved by rotating the adjustment plate 64, 68 of FIG. 11C to the positions shown in FIGS. 11E, 11G, and 11I.

In other embodiments, multiple adjustment plates can be provided each having different offsets of the adjustment openings 65, 69. For example, each of the adjustment plates 64, 68 shown in FIGS. 11A-11I can be manufactured separately and provided with a kit. As a result, the desired offset of the carrier plate 56 and thus the roller pin 80 can be achieved by swapping adjustment plates 64, 68 as opposed to rotating the same adjustment plate 64, 68 to different rotational positions within the recesses 57, 58.

Similar to differently offset adjustment plates 64, 68, differently sized shim plates may be utilized with the ring adjustment assembly 40, such as the shim plate 152 shown in FIGS. 12A and 12B. The shim plate 152 shown in FIGS. 12A and 12B has a larger thickness 155 than the thickness 55 of the shim plate 52 of FIGS. 4A-10C. As a result of the larger thickness 155, the shim plate 152 locates the central axis 81 of the roller pin 80 at an axial distance 182 from the annular ring 30 that is larger than the axial distance 82 described above. In other embodiments, a kit of the assembly 36 may further include additional shim plates that can be swapped out for the shim plates 52, 152 described herein. For example, the kit of the assembly 36 may include a shim plate that has a thickness that is smaller than the thicknesses 55, 155 of the shim plates 52, 152 described herein.

With the cam plate assembly 90 and the vane adjustment assembly 36, the positioning of the annular ring 30 can be finely adjusted. In particular, the position of the annular ring 30 can be adjusted via adjustment of the roller pin 80 via the shim plate 52, including shim plates of varying thicknesses, as well as the adjustment plates 64, 68 described above. Furthermore, the roller pins 80 can be moved within the slots 93, 94, 95, 96 of the cam plate 91 via axial movement of the cam plate 91, and thus the position of the annular ring 30 can be correspondingly adjusted.

A method of adjusting a position of a plurality of variable vanes of a gas turbine engine according to a further aspect of the present disclosure includes arranging the plurality of variable vanes around a central axis of the gas turbine engine, arranging an annular ring radially outward of the central axis, and coupling the annular ring to the plurality of variable vanes. The method can further include arranging a carrier plate adjacent to the annular ring, the carrier plate having a roller pin coupled to a second carrier surface of the carrier plate opposite a first carrier surface. The method can further include arranging a first shim plate between the carrier plate and the annular ring, the first shim plate sized so as to locate the roller pin at a first predetermined distance from the annular ring so as to adjust a position of the plurality of variable vanes relative to the roller pin.

The method can further include inserting a first fastener axially into the annular ring such that the first fastener extends axially through the annular ring, through the shim plate, and through the carrier plate so as to couple the shim plate and the carrier plate to the annular ring. The method can further include removing the first shim plate from between the carrier plate and the annular ring and inserting a second shim plate between the carrier plate and the annular ring, the second shim plate having a thickness as measured in an axial direction relative to the annular ring different than the first shim plate so as to locate the roller pin at a second predetermined distance from the annular ring different than the first predetermined distance so as to adjust a position of the plurality of variable vanes relative to the roller pin.

The method can further include arranging a first adjustment plate within a first recess of the carrier plate. The first adjustment plate includes a first adjustment opening that extends axially through the first adjustment plate, and the first fastener extends through the first adjustment opening. The recess opens axially outwardly away from the annular ring. The carrier plate includes a first opening formed in a bottom surface of the first recess that extends axially through the carrier plate, and the first fastener extends through the first opening and extends beyond the second carrier surface of the carrier plate.

The first adjustment opening is offset from a central axis of the adjustment plate extending in an axial direction relative to the annular ring in at least one of a circumferential direction of the annular ring and a radial direction of the annular ring such that the carrier plate and the roller pin are offset from the shim plate in a direction opposite of the at least one of the circumferential direction and the radial direction.

A method of adjusting a position of a plurality of variable vanes of a gas turbine engine according to a further aspect of the present disclosure includes arranging the plurality of variable vanes around a central axis of the gas turbine engine, arranging an annular ring radially outward of the central axis, and coupling the annular ring to the plurality of variable vanes.

The method can further include arranging a carrier plate adjacent to the annular ring, the carrier plate having a roller pin coupled to a second carrier surface of the carrier plate opposite a first carrier surface, and arranging a first shim plate between the carrier plate and the annular ring, the first shim plate sized so as to locate the roller pin a first predetermined distance from the annular ring so as to adjust a position of the plurality of variable vanes relative to the roller pin. The method can further include inserting a fastener axially through the annular ring, through the first shim plate, and through the carrier plate, a first portion of the fastener extending axially beyond the carrier plate, arranging an adjustment plate on the second carrier surface of the carrier plate, the adjustment plate including an adjustment opening through which the first portion of the fastener extends when the adjustment plate is arranged on the carrier plate, and securing the first shim plate, the carrier plate, and the adjustment plate to the annular ring via a nut tightened against the adjustment plate on the first portion of the fastener.

The adjustment plate can be configured to be arranged on the carrier plate at a plurality of rotational positions therein relative to a central axis of the adjustment plate extending an axial direction relative to the annular ring, and the adjustment opening can be offset from the central axis in a first direction that is at least one of a circumferential direction of the annular ring and a radial direction of the annular ring such that the carrier plate and the roller pin are offset from the shim plate in a second direction opposite the first direction, the second direction corresponding to a first rotational position of the adjustment plate.

The method can further include removing the adjustment plate from the carrier plate and reinserting the adjustment plate on the carrier plate at a second rotational position different than the first rotational position such that the adjustment opening is offset from the central axis in a third direction different than the first direction such that the carrier plate and the roller pin are offset from the carrier plate in a fourth direction opposite the third direction.

The method can further include removing the first shim plate from between the carrier plate and the annular ring and inserting a second shim plate between the carrier plate and the annular ring, the second shim plate having a thickness as measured in an axial direction relative to the annular ring different than the first shim plate so as to locate the roller pin at a second predetermined distance from the annular ring different than the first predetermined distance so as to adjust a position of the plurality of variable vanes relative to the roller pin.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A vane adjustment assembly for a gas turbine engine, comprising a plurality of variable vanes extending radially outward relative to a central axis of the gas turbine engine, an annular ring arranged radially outward of the central axis and coupled to the plurality of variable vanes, and a ring adjustment assembly including a shim plate having a first shim surface removably arranged on an axially facing surface of the annular ring, a carrier plate having a first carrier surface removably arranged on a second shim surface of the shim plate opposite the first shim surface, and a roller pin coupled to a second carrier surface of the carrier plate opposite the first carrier surface, wherein the shim plate is sized so as to locate the roller pin at a predetermined distance from the annular ring so as to adjust a position of the plurality of variable vanes relative to the roller pin.

2. The vane adjustment assembly of claim 1, wherein the ring adjustment assembly further includes a first fastener extending axially through the annular ring, through the shim plate, and through the carrier plate.

3. The vane adjustment assembly of claim 2, wherein the carrier plate further includes a first recess formed in the second carrier surface, wherein the recess opens axially outwardly away from the annular ring, wherein the carrier plate includes a first opening formed in a bottom surface of the first recess extends axially through the carrier plate, and wherein the first fastener extends through the first opening and extends beyond the second carrier surface of the carrier plate.

4. The vane adjustment assembly of claim 3, wherein the ring adjustment assembly further includes a first adjustment plate arranged within the first recess, wherein the first adjustment plate includes a first adjustment opening that extends axially through the first adjustment plate, and wherein the first fastener extends through the first adjustment opening.

5. The vane adjustment assembly of claim 4, wherein the first fastener is removable such that the first fastener, the shim plate, the carrier plate, and the first adjustment plate are configured to be removed and reattached to the annular ring via replacing the first fastener, and wherein the first adjustment plate is configured to be arranged within the first recess at a plurality of rotational positions therein relative to a central axis of the first adjustment plate that extends in an axial direction relative to the annular ring.

6. The vane adjustment assembly of claim 5, wherein the first adjustment opening is offset from the central axis of the first adjustment plate in at least one of a circumferential direction of the annular ring and a radial direction of the annular ring.

7. The vane adjustment assembly of claim 6, wherein the first adjustment opening is offset from the central axis of the first adjustment plate in a first circumferential direction of the annular ring such that the carrier plate and the roller pin are offset from the shim plate in a second circumferential direction opposite the first circumferential direction.

8. The vane adjustment assembly of claim 6, wherein the first adjustment opening is offset from the central axis of the first adjustment plate in a first radial direction of the annular ring such that the carrier plate and the roller pin are offset from the shim plate in a second radial direction opposite the first radial direction.

9. The vane adjustment assembly of claim 4, wherein the roller pin is selectively movably coupled to a casing of the gas turbine engine such that movement of the roller pin relative to the casing further adjusts the position of the annular ring relative to the casing, wherein the roller pin is selectively movably coupled to the casing via a cam plate that is slidably coupled to the casing and slidable relative thereto, and wherein the cam plate includes at least one slot within which the roller pin is slidably arranged.

10. The vane adjustment assembly of claim 9, wherein sliding of the cam plate relative to the casing in an axial direction causes the roller pin to slidably move within the at least one slot and further adjust a position of the annular ring relative to the casing, and wherein the roller pin includes a roller pin head configured to be slidably arranged within the at least one slot and engage with edges of the at least one slot.

11. A method of adjusting a position of a plurality of variable vanes of a gas turbine engine, comprising arranging the plurality of variable vanes around a central axis of the gas turbine engine arranging an annular ring radially outward of the central axis, coupling the annular ring to the plurality of variable vanes, arranging a carrier plate adjacent to the annular ring, the carrier plate having a roller pin coupled to a second carrier surface of the carrier plate opposite a first carrier surface, and arranging a first shim plate between the carrier plate and the annular ring, the first shim plate sized so as to locate the roller pin at a first predetermined distance from the annular ring so as to adjust a position of the plurality of variable vanes relative to the roller pin.

12. The method of claim 11, further comprising:

inserting a first fastener axially into the annular ring such that the first fastener extends axially through the annular ring, through the shim plate, and through the carrier plate so as to couple the shim plate and the carrier plate to the annular ring.

13. The method of claim 12, further comprising:

removing the first shim plate from between the carrier plate and the annular ring and inserting a second shim plate between the carrier plate and the annular ring, the second shim plate having a thickness as measured in an axial direction relative to the annular ring different than the first shim plate so as to locate the roller pin at a second predetermined distance from the annular ring different than the first predetermined distance so as to adjust a position of the plurality of variable vanes relative to the roller pin.

14. The method of claim 13, wherein the carrier plate further includes a first recess formed in the second carrier surface, wherein the recess opens axially outwardly away from the annular ring, wherein the carrier plate includes a first opening formed in a bottom surface of the first recess that extends axially through the carrier plate, and wherein the first fastener extends through the first opening and extends beyond the second carrier surface of the carrier plate.

15. The method of claim 14, further comprising:

arranging a first adjustment plate within the first recess, wherein the first adjustment plate includes a first adjustment opening that extends axially through the first adjustment plate, and wherein the first fastener extends through the first adjustment opening.

16. The method of claim 15, wherein the first adjustment opening is offset from a central axis of the adjustment plate extending in an axial direction relative to the annular ring in at least one of a circumferential direction of the annular ring and a radial direction of the annular ring such that the carrier plate and the roller pin are offset from the shim plate in a direction opposite of the at least one of the circumferential direction and the radial direction.

17. A method of adjusting a position of a plurality of variable vanes of a gas turbine engine, comprising arranging the plurality of variable vanes around a central axis of the gas turbine engine arranging an annular ring radially outward of the central axis, coupling the annular ring to the plurality of variable vanes, arranging a carrier plate adjacent to the annular ring, the carrier plate having a roller pin coupled to a second carrier surface of the carrier plate opposite a first carrier surface, arranging a first shim plate between the carrier plate and the annular ring, the first shim plate sized so as to locate the roller pin a first predetermined distance from the annular ring so as to adjust a position of the plurality of variable vanes relative to the roller pin, inserting a fastener axially through the annular ring, through the first shim plate, and through the carrier plate, a first portion of the fastener extending axially beyond the carrier plate, arranging an adjustment plate on the second carrier surface of the carrier plate, the adjustment plate including an adjustment opening through which the first portion of the fastener extends when the adjustment plate is arranged on the carrier plate, and securing the first shim plate, the carrier plate, and the adjustment plate to the annular ring via a nut tightened against the adjustment plate on the first portion of the fastener.

18. The method of claim 17, wherein the adjustment plate is configured to be arranged on the carrier plate at a plurality of rotational positions therein relative to a central axis of the adjustment plate extending an axial direction relative to the annular ring, and wherein the adjustment opening is offset from the central axis in a first direction that is at least one of a circumferential direction of the annular ring and a radial direction of the annular ring such that the carrier plate and the roller pin are offset from the shim plate in a second direction opposite the first direction, the second direction corresponding to a first rotational position of the adjustment plate.

19. The method of claim 18, further comprising:

removing the adjustment plate from the carrier plate and reinserting the adjustment plate on the carrier plate at a second rotational position different than the first rotational position such that the adjustment opening is offset from the central axis in a third direction different than the first direction such that the carrier plate and the roller pin are offset from the carrier plate in a fourth direction opposite the third direction.

20. The method of claim 19, further comprising:

removing the first shim plate from between the carrier plate and the annular ring and inserting a second shim plate between the carrier plate and the annular ring, the second shim plate having a thickness as measured in an axial direction relative to the annular ring different than the first shim plate so as to locate the roller pin at a second predetermined distance from the annular ring different than the first predetermined distance so as to adjust a position of the plurality of variable vanes relative to the roller pin.

* * * * *